US008845073B2

(12) United States Patent
Hawryschuk et al.

(10) Patent No.: US 8,845,073 B2
(45) **Date of Patent: *Sep. 30, 2014**

(54) INKJET PRINTING WITH CONDENSATION CONTROL

(71) Applicant: Eastman Kodak Company, Rochester, NY (US)

(72) Inventors: Timothy John Hawryschuk, Miamisburg, OH (US); Michael Joseph Piatt, Dayton, OH (US); Harsha S. Bulathsinghalage, Miamisburg, OH (US); Randy Dae Vandagriff, Xenia, OH (US)

(73) Assignee: Eastman Kodak Company, Rochester, NY (US)

( * ) Notice: Subject to any disclaimer, the term of this patent is extended or adjusted under 35 U.S.C. 154(b) by 19 days.

This patent is subject to a terminal disclaimer.

(21) Appl. No.: 13/721,118

(22) Filed: Dec. 20, 2012

(65) Prior Publication Data

US 2014/0176640 A1 Jun. 26, 2014

(51) Int. Cl.
*B41J 2/165* (2006.01)

(52) U.S. Cl.
CPC ..... *B41J 2/16505* (2013.01)
USPC ..... 347/34

(58) Field of Classification Search
CPC ..... B41J 2/1714
See application file for complete search history.

(56) References Cited

U.S. PATENT DOCUMENTS

| | | | | |
|---|---|---|---|---|
| 6,340,225 | B1 | 1/2002 | Szlucha | |
| 6,390,618 | B1 | 5/2002 | Wotton et al. | |
| 6,439,712 | B1 | 8/2002 | Mizutani et al. | |
| 6,463,674 | B1 | 10/2002 | Meyers et al. | |
| 6,517,197 | B2 | 2/2003 | Hawkins et al. | |
| 6,712,448 | B2 | 3/2004 | Tsurui | |
| 6,863,393 | B2 | 3/2005 | Patterson et al. | |
| 7,384,112 | B2 | 6/2008 | Hasegawa | |
| 8,011,779 | B2 | 9/2011 | Matsuhashi | |
| 2005/0099451 | A1 | 5/2005 | Kuester et al. | |
| 2013/0293620 | A1* | 11/2013 | Tunmore et al. | 347/17 |

* cited by examiner

*Primary Examiner* — Justin Seo
(74) *Attorney, Agent, or Firm* — Roland R. Schindler; William R. Zimmerli

(57) ABSTRACT

Inkjet printing methods are described that create a combination of higher resistance flow areas and lower resistance flow areas to allow a vaporized carrier fluid reducing airflow to flow between a printing module and a receiver without disrupting inkjet drop placements. Removal of the vaporized carrier fluid reduces condensation.

21 Claims, 23 Drawing Sheets

INKJET PRINTING WITH CONDENSATION CONTROL

CROSS REFERENCE TO RELATED APPLICATIONS

This application is related to commonly assigned, U.S. application Ser. No. 13/721,126, filed Dec. 20, 2012; U.S. Ser. No. 13/721,106, filed Dec. 20, 2012; U.S. Ser. No. 13/721,109, filed Dec. 20, 2012; U.S. Ser. No. 13/721,104, filed Dec. 20, 2012; U.S. Ser. No. 13/721,102, filed Dec. 20, 2012; Ser. No. 13/721,096, filed Dec. 20, 2012; U.S. Ser. No. 13/721,091, filed Dec. 20, 2012, now U.S. Pat. No. 8,690, 292; and U.S. Ser. No. 13/721,115, filed Dec. 20, 2012, each of which is hereby incorporated by reference.

FIELD OF INVENTION

The present invention relates to controlling condensation of vaporized liquid components of inkjet inks during inkjet ink printing.

BACKGROUND OF THE INVENTION

In an ink jet printer, a print is made by ejecting or jetting a series of small droplets of ink onto a paper to form picture elements (pixels) in an image-wise pattern. The density of a pixel is determined by the amount of ink jetted onto an area. Control of pixel density is generally achieved by controlling the number of droplets of ink jetted into an area of the print. To produce a print containing a single color, for example a black and white print, it is only necessary to jet a single black ink so that more droplets are directed at areas of higher density than areas with lower density.

Color prints are generally made by jetting, in register, inks corresponding to the subtractive primary colors cyan, magenta, yellow, and black. In addition, specialty inks can also be jetted to enhance the characteristics of a print. For example, custom colors to expand the color gamut, low density inks to expand the gray scale, and protective inks such as those containing UV absorbers can also be jetted to onto a paper to form a print.

Ink jet inks are generally jetted onto the paper using a jetting head. Such heads can jet continuously using a continuously jetting print head, with ink jetted towards unmarked or low density areas deflected into a gutter and recycled back into the ink reservoir. Alternatively, ink can be jetted only where it is to be deposited onto the paper using a so-called drop on demand print head. Commonly used heads eject or jet droplets of ink using either heat (a thermal print head) or a piezoelectric pulse (a piezoelectric print head) to generate the pressure on the ink in a nozzle of the print head to cause the ink to fracture into a droplet and eject from the nozzle. Inkjet printing is commonly used for printing on a cellulose based paper, however, there are numerous other materials in which inkjet is appropriate. For example, vinyl sheets, plastic sheets, textiles, paperboard, and corrugated cardboard can comprise the print media. For simplicity, the term paper will be used to refer to any form of print media, upon which the inkjet system deposits ink or other liquids. Additionally, although the term inkjet is often used to describe the printing process, the term jetting is also appropriate wherever ink or other liquids is applied in a consistent, metered fashion, particularly if the desired result is a thin layer or coating.

Ink jet printers can broadly be classified as serving one of two markets. The first is the consumer market, where printers are slow; typically printing a few pages per minute and the number of pages printed is low. The second market consists of commercial printers, where speeds are typically at least hundreds of pages per minute for cut sheet printers and hundreds of feet per minute for web printers. For use in the commercial market, ink jet prints must be actively dried as the speed of the printers precludes the ability to allow the prints to dry without specific drying subsystems.

FIG. 1 is a system diagram of one example of a prior art commercial printing system 2. In the example of FIG. 1, commercial printing system 2 has a supply 4 of a paper 6 and a transport system 8 for moving paper 6 past a plurality of printheads 10A, 10B, and 10C. Printheads 10A, 10B and 10C eject ink droplets onto paper 6 as paper 6 is moved past printheads 10A, 10B and 10C by transport system 8. Transport system 8 then moves paper 6 to an output area 14. In this example, paper 6 is shown as a continuous web that is drawn from a spool type supply 4, past printheads 10A, 10B and 10C to an output area 14 where the printed web is wound on to a spool 18. In the embodiment illustrated here, transport system 8 comprises a motor that rotates spool 18 to pull paper 6 past printheads 10A, 10B and 10C.

Inkjet inks generally comprise up to about 97% water or another jettable carrier fluid such as an alcohol that carries colorants such as dyes or pigments dissolved or suspended therein to the paper. Ink jet inks also conventionally include other materials such as humectants, biocides, surfactants, and dispersants. Protective materials such as UV absorbers and abrasion resistant materials may also be present in the inkjet inks. Any of these may be in a liquid form or may be delivered by means of a liquid carrier or solvent. Conventionally, these liquids are selected to quickly vaporize after printing so that a pattern of dry colorants and other materials forms on the receiver soon after jetting.

Commercial inkjet printers typically print at rates of more than fifty feet of printing per minute. This requires printheads 10A, 10B and 10C to eject millions of droplets 12A, 12B and 12C of inkjet ink per minute. Accordingly, substantial volumes of liquids are ejected and begin evaporating at each of printheads 10A, 10B and 10C during operation of such printers.

When an ink jet image is printed on an absorbent paper, the inkjet ink droplets penetrate and are rapidly absorbed by the paper. As the ink is absorbed into the paper, the carrier fluid in the ink droplets spread colorants. A certain extent of spreading is anticipated and this spreading achieves the beneficial effect of increasing the extent of a surface area of the paper covered by the inkjet ink color. However, where spreading exceeds an expected extent, printed images can exhibit any or all of a loss of resolution, a decrease in color saturation, a decrease in density or image artifacts created by unintended combinations of colorants.

Absorption of the carrier fluid from inkjet inks can also have the effect of modifying the dimensional stability of an absorbent paper. In this regard it will be appreciated that the process of paper fabrication creates stresses in the paper that are balanced to create a flat paper stock. However, wetting of the paper causes the paper fibers to expand and partially or completely releases initially balanced stresses. In response, the paper cockles and distorts creating significant difficulties during subsequent paper handling, printing, or finishing applications. Cockle and distortion can degrade color to color registration, color saturation, and can also degrade any stitching of the print made when multiple jetting modules are used in combination to form a continuous imaging area across a width of the print. In addition, cockle and distortion of a print can impede the ability of a printing system to print front and back sides of a paper in register, often referred to as justification.

Further, in some situations, the jetting of large amounts of inkjet ink onto an absorbent paper can reduce the web strength of the paper. This can be particularly problematic in printers such as inkjet printing system 2 that is illustrated in FIG. 1, where, paper 6 is advanced by pulling the paper as the pulling applies additional external stresses to the paper that can further distort the paper.

Semi-absorbent papers absorb the ink more slowly than do absorbent papers. Inkjet printing on semi-absorbent papers can cause liquids from the inkjet ink to remain in liquid form on a surface of the paper for a period of time. Such ink is subject to smearing and offsetting if another surface contacts the printed surface before the carrier fluid in the ink evaporates and the colorant is fixed. Air flow caused by either a drying process or by the transport of the paper can also distort the wet print. Finally, external contaminants such as dust or dirt can adhere to the wet ink, resulting in image degradation.

To avoid these effects, high speed inkjet printed papers are frequently actively dried using one or more dryers such as dryers 16A, 16B and 16C shown in FIG. 1. Dryers 16A, 16B and 16C typically heat the printed paper 6 and ink to increase the evaporation rate of carrier fluid from paper 6 in order to reduce drying times. As is shown in FIG. 1, dryers 16A, 16B and 16C are typically positioned as close to the jetting assembly as possible so that the ink is dried in as short a time as possible after being jetted onto paper 6. This has been found to improve print quality by improving the optical density of the images, increasing color saturation, reducing color to color ink bleed, and reducing the cokle and curl of the paper. Indeed, it would be desirable to position the dryer subsystem in the vicinity of the jetting module. In many systems, it is desirable to locate the dryers between the printheads 10A, 10B, and 10C rather than place the dryers downstream of all the printheads to gain these benefits.

However, the increased rate at which carrier fluid evaporates creates localized concentrations of vaporized carrier fluid 17. Further around printing heads 10A, 10B and 10C, movement of paper 6 through printer 2 drags air and carrier fluid along with paper 6 forming current 15 of air that carries a meaningful portion of vaporized carrier fluid 17 therein that travels along with printed paper 6 as printed paper 6 moves from print head 10A, to printhead 10B and on to printhead 10C. Accordingly, when a printed portion of paper 6 reaches second printing area 10B a second inkjet image is printed and a concentration of vaporized carrier fluid 17 in the portion of current 15 moving with paper 6 is further increased. A similar result occurs at printhead 10C.

These concentrations increase the probability that vaporized carrier fluids 17 will condense on structures within printer 2 that are at a temperature that is below a condensation point of the evaporated carrier fluid. Such condensation can have a variety of effects on mechanical and electrical systems in printer 2. Further, there is the risk that such condensation will form droplets 19 on structures such as printhead 10B or printhead 10C from which they can fall, transfer or otherwise come into contact with a printed paper 6 so as to create image artifacts on paper 6. This risk is particularly acute for structures that are in close proximity to paper 6. Although the evaporated and condensed carrier fluid is substantially clear, as it contacts surfaces that have colorant deposits such deposits mix with the carrier fluid giving it color that detracts from the printed image when deposited there upon.

Additionally, there is the risk that such condensation forms in such locations where the condensation can combine with carrier fluid in ink droplets jetted toward a receiver to create image artifacts and can also interfere with droplet formation and/or can negatively influence the flight path taken by the droplets. Accordingly, it is desirable to provide some level of protection against the formation of such droplets of condensation at the printhead.

It will also be appreciated that it is frequently the case that several printheads are used in proximity to form what is known in the art as a printing module or linehead. Concentrations of vaporized carrier fluid can vary significantly at different printheads in the printing module. In part this occurs because the air current 15 carries vaporized carrier fluid along the receiver 6 as receiver 6 is moved from printhead to printhead such that the amount of vaporized carrier fluid in air current 15 increases as receiver 6 passes each print head.

U.S. Pat. No. 6,340,225 entitled: "Cross floor care system for inkjet printer" and U.S. Pat. No. 6,390,618 entitled "Method and apparatus for inkjet print zone drying." These describe systems that blow air through a printing zone to enhance printing efficiency and to reduce cost. It will be appreciated that such systems introduce air flow that cuts across the printing zone between the printheads and the receiver and that therefore can disrupt the trajectory of the ink droplets and introduce image artifacts in to the receiver.

Accordingly, what is also needed are new printers and air flow systems for printers that can create without creating unwanted image artifacts.

SUMMARY OF THE INVENTION

Methods of printing with condensation control are provided. In one embodiment, a method involves using one of a plurality of caps that extend from a barrier at each of a plurality of inkjet printheads toward a receiver to create higher resistance flow areas between the caps and the receiver having a higher resistance to airflow than is found in lower resistance airflow channels between the caps, the barrier and the receiver; directing ink droplets to pass from the inkjet printheads through cap openings in the higher resistance flow areas and onto the receiver; and providing a cross-module air flow between the barrier and the receiver. The higher resistance to airflow in the higher resistance flow areas causes the cross-module airflow to flow through the lower resistance airflow channels without creating flows in the higher resistance flow areas that cause variations in the travel paths of the ink droplets that are sufficient to form an artifact in a print made on the receiver using the ink droplets.

Unless otherwise stated expressly herein the drawings are not to scale.

DETAILED DESCRIPTION OF THE INVENTION

Figure 1:
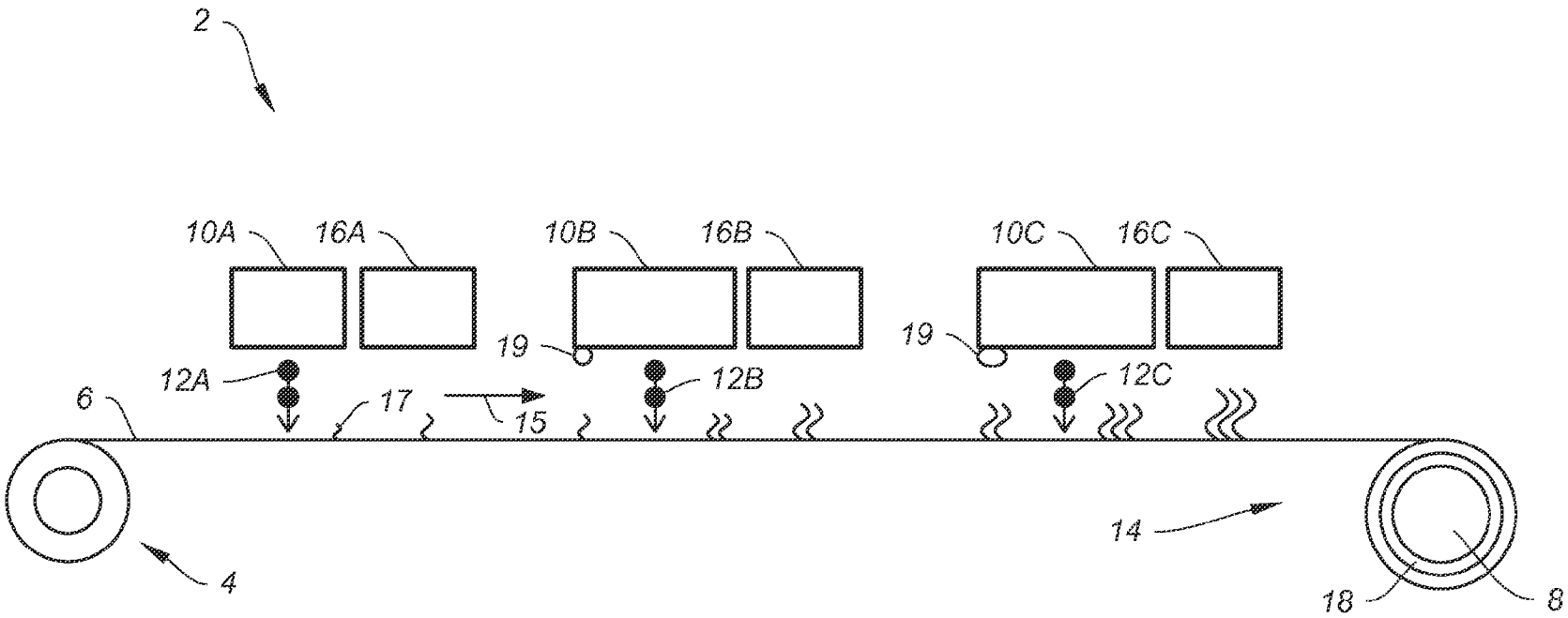
FIG. 1 (Prior Art)
FIG. 1 illustrates a side schematic view of a prior art inkjet printing system.
Figure 2:
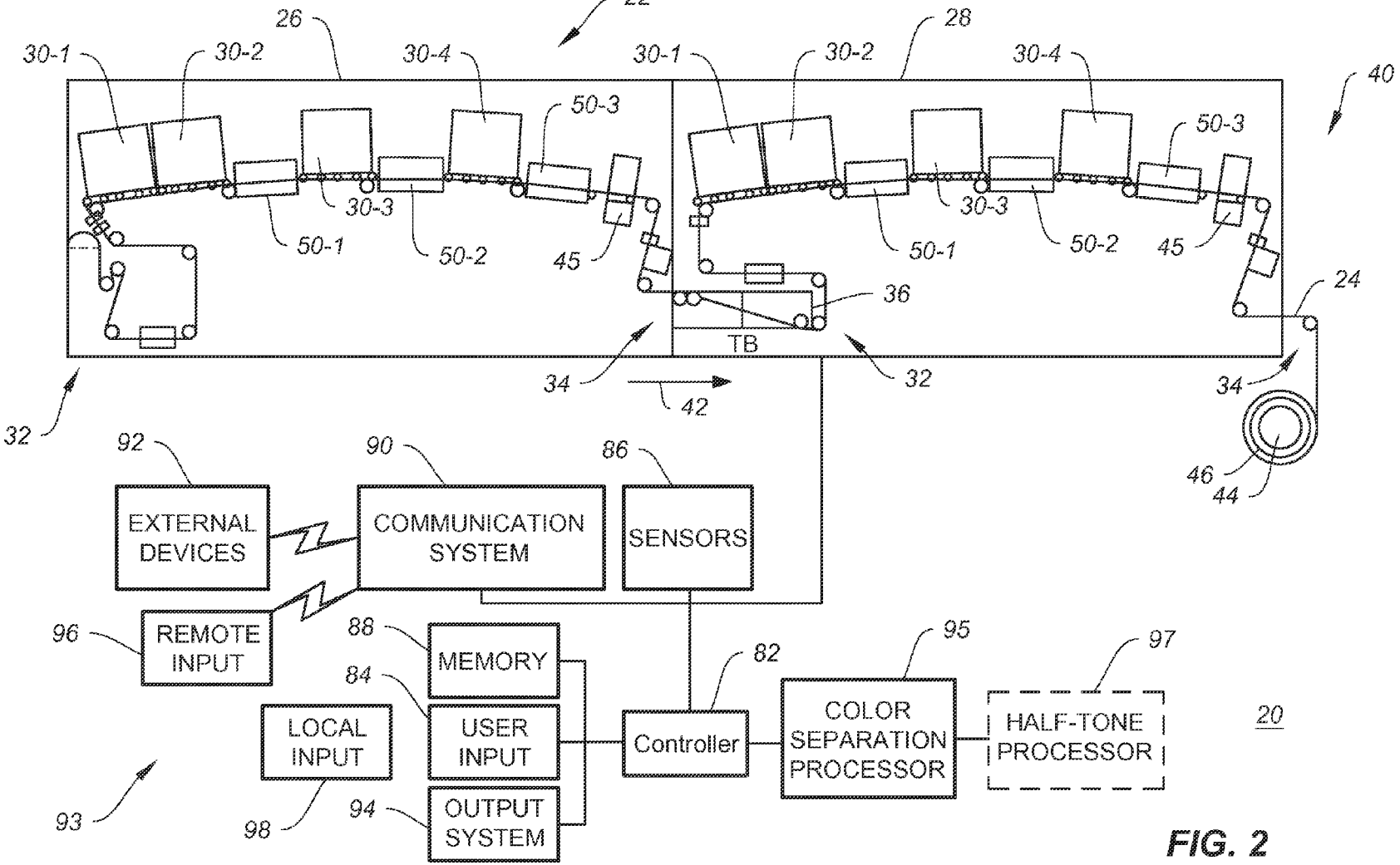
FIG. 2 illustrates a side schematic view of one embodiment of an inkjet printing system.

FIG. 2 is a side schematic view of a first embodiment of an inkjet printing system 20. Inkjet printing system 20 has an inkjet print engine 22 that delivers one or more inkjet images in registration onto a receiver 24 to form a composite inkjet image. Such a composite inkjet image can be used for any of a plurality of purposes, the most common of which is to provide a printed image with more than one color. For example, in a four color image, four inkjet images are formed, with each inkjet image having one of the four subtractive primary colors, cyan, magenta, yellow, and black. The four color inkjet inks can be combined to form a representative spectrum of colors. Similarly, in a five color image various combinations of any of five differently colored inkjet inks can be combined to form a color print on receiver 24. That is, any of five colors of inkjet ink can be combined with inkjet ink of one or more of the other colors at a particular location on receiver 24 to form a color after a fusing or fixing process that is different than the colors of the inkjets inks applied at that location.

In the embodiment of FIG. 2, inkjet print engine 22 is optionally configured with a first print engine module 26 and a second print engine module 28. In this embodiment, first print engine module 26 and second print engine module 28 have corresponding sequences of printing modules 30-1, 30-2, 30-3, 30-4, also known as lineheads that are positioned along a direction of receiver movement 42. Printing modules 30-1, 30-2, 30-3, 30-4 each have an arrangement of printheads (not shown in FIG. 2) to deliver ink droplets (not shown) to form picture elements that create a single inkjet image on a receiver 24 as receiver 24 is advanced from an input area 32 to an output area 34 by a receiver transport system 40 along the direction of receiver movement 42.

Receiver transport system 40 generally comprises structures, systems, actuators, sensors, or other devices used to advance a receiver 24 from an input area 32 past print engine 22 to an output area 34. In FIG. 2, receiver transport system 40 comprises a plurality of rollers R, and optionally other forms of contact surfaces that are known in the art for guiding and directing a continuous type receiver 24. As is also shown in the embodiment of FIG. 2, first print engine module 26 has an output area 34 that is connected to an input area 32 of second print engine module 28 by way of an inverter module 36. In operation, receiver 24 is first moved past first print engine module 26 which forms one or more inkjet images on a first side of receiver 24, and is then inverted by inverter module 36 so that second print engine module 28 forms one or more inkjet images in registration with each other on a second side of receiver 24. A motor 44 is positioned proximate to output area 34 of second print engine module 28 that rotates a spool 46 to draw receiver 24 through first print engine module 26 and second print engine module 28. Additional driven rollers in the first print engine module 26 and in the second print engine module 28 can be used to maintain a desired tension in receiver 24 as it passes print engine 22.

Figure 3:
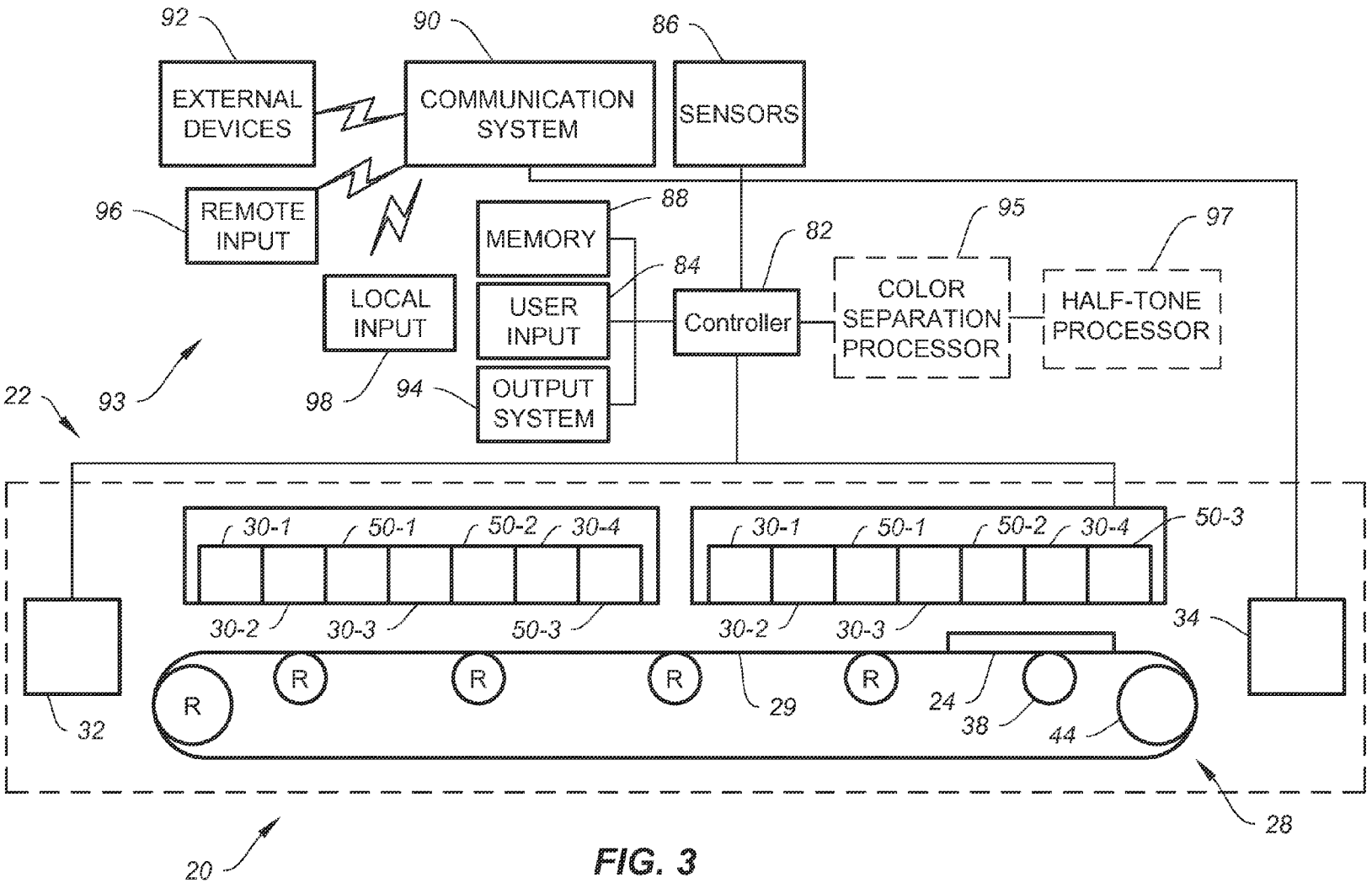
FIG. 3 illustrates a side schematic view of another embodiment of an inkjet printing system.

In an alternate embodiment illustrated in FIG. 3, a print engine 22 is optionally illustrated with only a first print engine module 26 and with a receiver transport system 40 that includes a movable surface such as an endless belt 29 that is that is supported by rollers R which in turn is operated by a motor 44. Such an embodiment of a receiver transport system 40 is particularly useful when receiver 24 is supplied in the form of pages as opposed to a continuous web. However, in other embodiments receiver transport system 40 can take other forms and can be provided in segments that operate in different ways or that use different structures. Other conventional embodiments of a receiver transport system 40 can be used.

Inkjet printing system 20 is operated by a printing system controller 82 that controls the operation of print engine 22 including but not limited to each of the respective printing modules 30-1, 30-2, 30-3, 30-4 of first print engine module 26 and second print engine module 28, receiver transport system 40, input area 32, to form inkjet images in registration on a receiver 24 or an intermediate in order to yield a composite inkjet image on receiver 24.

Printing system controller 82 operates inkjet printing system 20 based upon input signals from a user input system 84, sensors 86, a memory 88 and a communication system 90. User input system 84 can comprise any form of transducer or other device capable of receiving an input from a user and converting this input into a form that can be used by printing system controller 82. Sensors 86 can include contact, proximity, electromagnetic, magnetic, or optical sensors and other sensors known in the art that can be used to detect conditions in inkjet printing system 20 or in the environment-surrounding inkjet printing system 20 and to convert this information into a form that can be used by printing system controller 82 in governing printing, drying, other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printing system controller 82.

Communication system 90 can comprise any form of circuit, system or transducer that can be used to send signals to or receive signals from memory 88 or external devices 92 that are separate from or separable from direct connection with printing system controller 82. External devices 92 can comprise any type of electronic system that can generate signals bearing data that may be useful to printing system controller 82 in operating inkjet printing system 20.

Inkjet printing system 20 further comprises an output system 94, such as a display, audio signal source or tactile signal generator or any other device that can be used to provide human perceptible signals by printing system controller 82 to an operator for feedback, informational or other purposes.

Inkjet printing system 20 prints images based upon print order information. Print order information can include image data for printing and printing instructions. Print order information can be received from a variety of sources. In the embodiment of FIGS. 2 and 3, these sources include memory 88, communication system 90, that inkjet printing system 20 can receive such image data through local generation or processing that can be executed at inkjet printing system 20 using, for example, user input system 84, output system 94 and printing system controller 82. Print order information can also be generated by way of remote input 56 and local input 66 and can be calculated by printing system controller 82. For convenience, these sources are referred to collectively herein as source of print order information 93. It will be appreciated, that this is not limiting and that the source of print order information 93 can comprise any electronic, magnetic, optical or other system known in the art of printing that can be incorporated into inkjet printing system 20 or that can cooperate with inkjet printing system 20 to make print order information or parts thereof available.

In the embodiment of inkjet printing system 20 that is illustrated in FIGS. 2 and 3, printing system controller 82 has an optional color separation image processor 95 to convert the image data into color separation images that can be used by printing modules 30-1, 30-2, 30-3, 30-4 of print engine 22 to generate inkjet images. An optional half-tone processor 97 is also shown that can process the color separation images according to any half-tone screening requirements of print engine 22.

Figure 4:
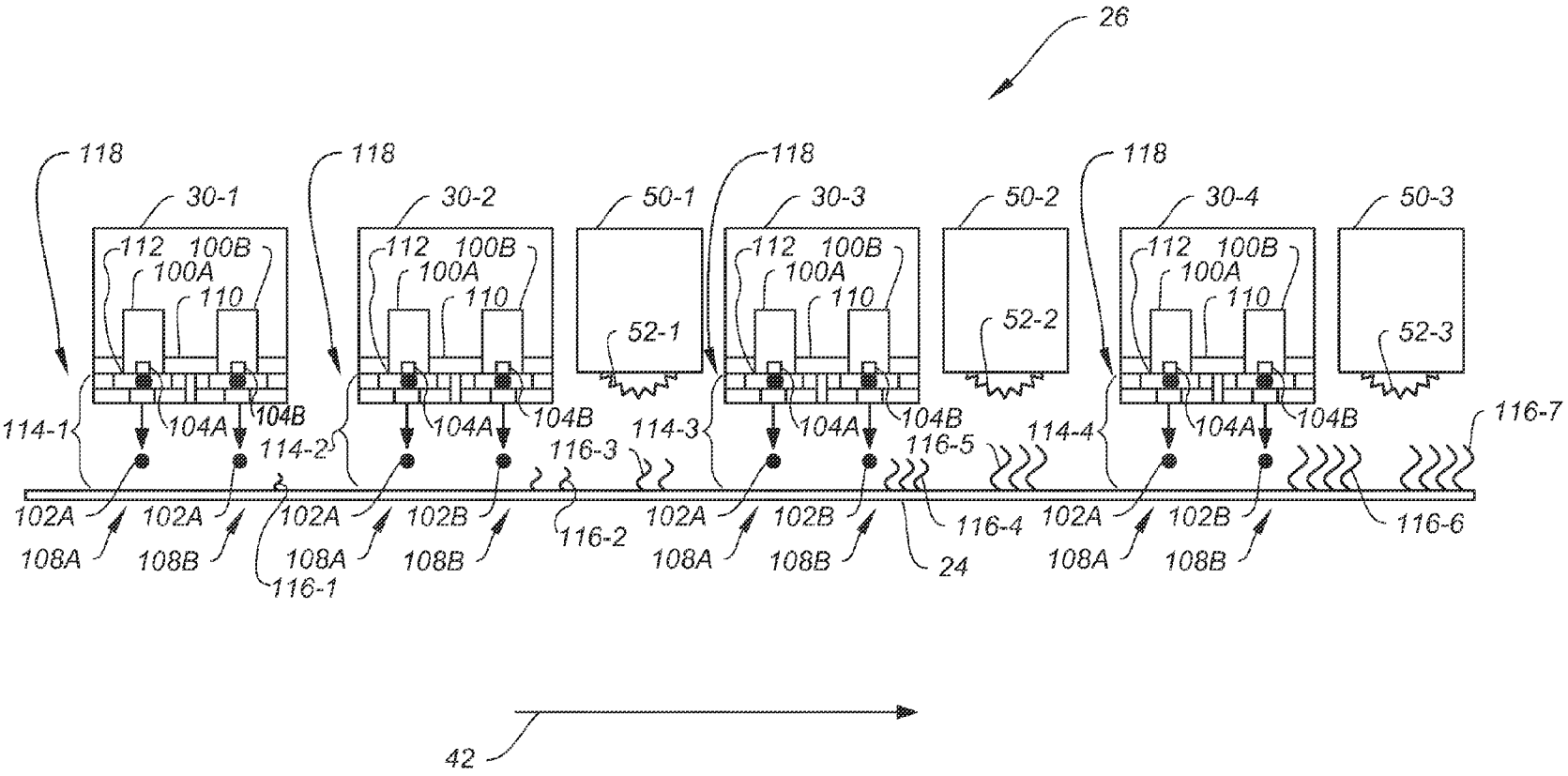
FIG. 4 provides, a schematic view of the embodiment of first print engine module of FIGS. 2-3 in greater detail

FIG. 4 provides a schematic view of one embodiment of a first print engine module 26. In this embodiment, receiver 24 is moved past a series of inkjet printing modules 30-1, 30-2, 30-3, 30-4 which typically include a plurality of inkjet printheads 100 that are positioned by a barrier 110 such that a face 106 of each of the inkjet printheads 100 is positioned so nozzle arrays 104A and 104B jet ink droplets 102A and 102B toward a target areas 108A and 108B. As used herein target areas 108A and 108B include any region into which ink droplets 102A and 102B are expected to land on a receiver 24 to form picture elements of an inkjet printed image.

Inkjet printheads 100 can use any known form of inkjet technology to jet ink droplets 102. These can include but are not limited to drop on demand inkjet jetting technology (DOD) or continuous inkjet jetting technology (CIJ). In "drop-on-demand" (DOD) jetting, a pressurization actuator, for example, a thermal, piezoelectric, or electrostatic actuator causes ink droplets to jet from a nozzle only when required. One commonly practiced drop-on-demand technology uses thermal actuation to eject ink droplets 102 from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

In "continuous" ink jet (CIJ) jetting, a pressurized ink source is used to produce a continuous liquid jet stream of ink by forcing ink, under pressure, through a nozzle. The stream of ink is perturbed using a drop forming mechanism such that the liquid jet breaks up into droplets of ink in a predictable manner. One continuous printing technology uses thermal stimulation of the liquid jet with a heater to form droplets that eventually become print droplets and non-print droplets. Printing occurs by selectively deflecting one of the print droplets and the non-print droplets and catching the non-print droplets. Various approaches for selectively deflecting droplets have been developed including electrostatic deflection, air deflection, and thermal deflection. The inventions described herein are applicable to both types of printing technologies and to any other technologies that enable jetting of droplets of an ink consistent with what is claimed herein. As such, inkjet printheads 100 are not limited to any particular jetting technology. In the embodiment of FIGS. 1-4, inkjet printing module 30-1 is illustrated as having two rows of individual printheads shown in side view as printheads 100A and 100B. However other configurations are possible.

In the embodiments that are shown in FIGS. 2-4 dryers 50-1, 50-2, 50-3, are provided to apply heat to help dry receiver 24 by accelerating evaporation of carrier fluid in the inkjet ink. Dryers 50-1, 50-2, and 50-3 can take any of a variety of forms including, but not limited to dryers that use radiated energy such as radio frequency emissions, visible light, infrared light, microwave emissions, or other such radiated energy from conventional sources to heat the carrier fluid directly or to heat receiver 24 so that receiver 24 heats the carrier fluid. Dryers 50-1, 50-2, and 50-3 can also apply heated air to a printed receiver 24 to heat the carrier fluid. Dryers 50-1, 50-2, and 50-3 can also include exhaust ducts for removal of air including vaporized carrier fluid 116 from the space under dryers 50-1, 50-2 and 50-3. In other embodiments, dryers 50-1, 50-2, and 50-3 can use heated surfaces such as heated rollers that support and heat receiver 24.

As ink droplets 102 are formed, travel to receiver 24, and are heated for drying, receiver 24 emits vaporized carrier fluid 116. This raises the concentration of vaporized carrier fluid 116 in a gap 114 between barrier 110 and target area 108. This effect is particularly acute in gaps 114 between printing module 30-1 and a target area 108 within which receiver 24 is positioned.

It will be noted that as carrier fluid is frequently water, terms such as moisture, humid, and humidity, may be used in this specification that in a proper sense relate only to water in either a liquid or gaseous form. For simplicity, these terms are also terms are intended to refer to the liquid and gaseous forms of non-aqueous solvents or carrier fluids in a corresponding manner. In various embodiments herein ink droplets 102 are generally referred to as delivering colorants to receiver 24 however, it will be appreciated that in alternate embodiments ink droplets 102 can deliver other functional materials thereto including coating materials, protectants, conductive materials and the like.

During printing, inkjet printing modules such as inkjet printing module 30-1, rapidly form and jet ink droplets 102 onto receiver 24. This process adds vaporized carrier fluid 116 to the air in gap 114-1, creating a first concentration of vaporized carrier fluid 116-1 and also increasing a risk of condensation on downstream portions of the barrier 110.

Further, as receiver 24 moves in the direction of receiver movement 42 (left to right as shown in FIG. 4), warm humid air adjacent to receiver 24 is dragged along or entrained by the moving receiver 24. As a result, a convective current develops and causes the warm humid air to flow along direction of receiver movement 42. When this happens, a substantial portion of the concentration of vaporized carrier fluid 116-1 in the air in a first gap 114-1 between nozzle arrays 104A and 104B and target areas 108A and 108B at inkjet printing module 30-1 travels with receiver 24 and enters a second gap 114-2 between nozzle arrays 104A and 104B and target areas 108A and 108B at inkjet printing module 30-2 where additional ink droplets 102 are emitted and add to the concentration of vaporized carrier fluid 116-1 to create a second concentration of vaporized carrier fluid 116-2 that is greater than the first concentration of vaporized carrier fluid 116-1.

Receiver 24 then passes beneath dryer 50-1 which applies energy 52-1 to heat receiver 24 and any ink thereon. The applied energy 52-1 accelerates the evaporation of the water or other carrier fluids in the ink. Although such dryers 50-1, 50-2, and 50-3 often include an exhaust system for removing the resulting warm humid air from above receiver 24, some warm air with vaporized carrier fluid 116 is carried along by moving receiver 24 as it leaves dryer 50-1. As a result, a third concentration of carrier fluid entering in third gap 114-3 between nozzle arrays 104A and 104B and target areas 108A and 108B at inkjet printing module 30-3 is greater than second concentration of vaporized carrier fluid 116-2. Similarly, printing of ink droplets 102 at inkjet printing module 30-3 creates a fourth concentration of vaporized carrier fluid 116-4 exiting gap 114-3. To the extent that receiver 24 remains at an increased temperature after leaving dryer 50-1, carrier fluid from the ink droplets 102A and 102B can be caused to evaporate from receiver 24 at a faster rate further adding moisture into gap 114-3 such that the fourth concentration of vaporized carrier fluid 116-4 is found in gap 114-4 after receiver 24 has been moved past inkjet printing module 30-2 and dryer 50-1.

Accordingly, where multiple inkjet printing modules 30 jet ink onto receiver 24, concentrations of vaporized carrier fluid 116 near a receiver 24 can increase in like fashion cascading from a first concentration of vaporized carrier fluid 116-1 to a second concentration of vaporized carrier fluid 116-2, to a third concentration of vaporized carrier fluid 116-3 and so on. As such, the risk of condensation related problems increases with each additional printing undertaken by inkjet printing modules 30-2, 30-3, and 30-4 downstream of dryer 50-1 it is necessary to reduce the risk that these concentrations will cause condensation that damages the printer or the printed output.

Multi-Zone Thermal Condensation Control

Figure 5:
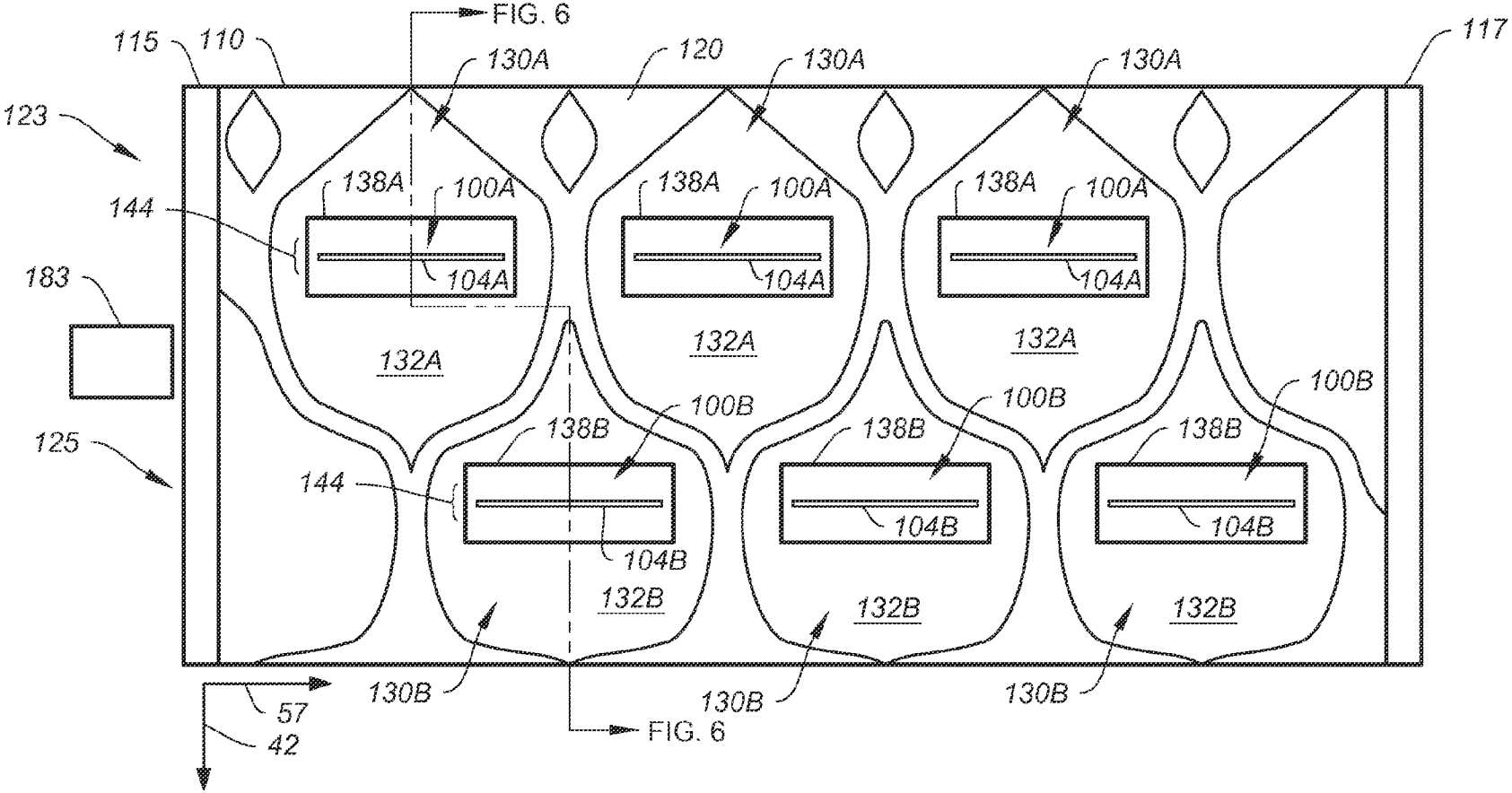
FIG. 5 shows a first embodiment of an apparatus for controlling condensation in an inkjet printing system.
Figure 6:
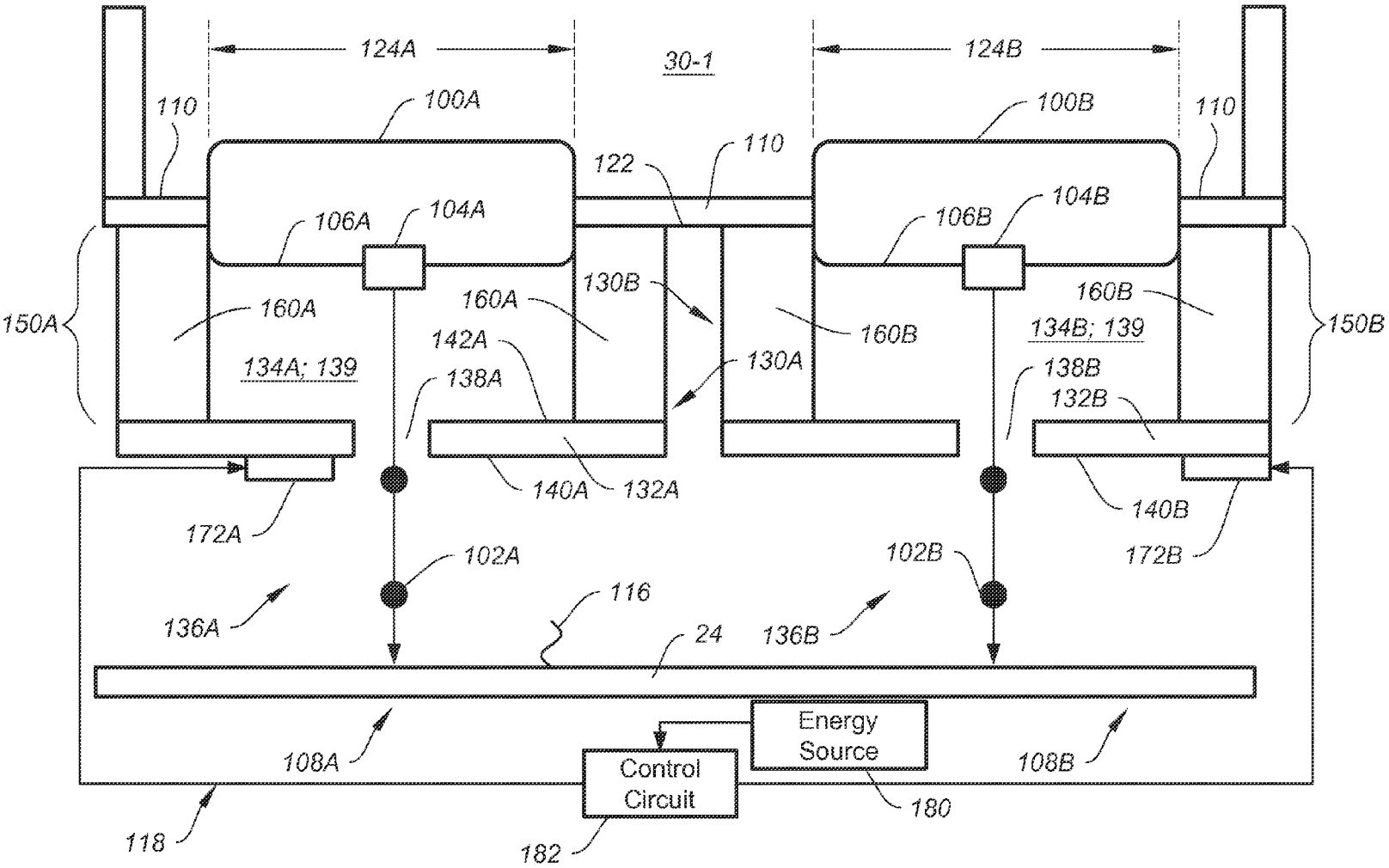
FIGS. 6 and 7 respectively illustrate a face of a barrier and a face of a corresponding shield that confront a target area.

FIGS. 5 and 6 show, respectively, a bottom perspective view and a section view of one embodiment of a condensation control system 118 that can be used with a printing module such as printing module 30-1.

This embodiment of condensation control system 118 includes caps 130A and 130B at each of printheads 100A and 100B. Caps 130A and 130B have shields 132A and 132B and thermally insulating separators 160A and 160B respectively. An energy source 180 provides energy that can be applied to cause shields 132A and 132B to be heated and a control circuit 182 controls an amount of energy that is applied to control the heating of shields 132A and 132B.

In this embodiment, printing module 30-1 has a first plurality of printheads 100A arranged along a first print line 123 and a second plurality of printheads 100B arranged along a second print line 125. As is shown in FIG. 6, each printhead 100A and 100B has a face 106A and 106B with a nozzle arrays 104A and 104B that extend to provide a printing width that is less than a desired extent of printing across width direction 57. Accordingly, the first plurality of inkjet printheads 100A. and 100B are arranged in an interlocking and offset manner with inkjet printheads 100 a provided in a spaced arrangement along first print line 123 with separations between the first plurality of printheads 100A being sized so that there are spaces between portions of width of a receiver 24 that are printed by the first plurality of printheads 100A that are less than a width of nozzle arrays 104B of the second plurality of printheads 100B. The second plurality of printheads 100B is arranged so that the second plurality of printheads 100B prints on portions of receiver 24 that are not printed on by the first plurality of printheads 100A. Using this arrangement of first plurality of printheads 100A and the second plurality of printheads 100B it is possible to print across a determined portion of width direction 57 in an unbroken manner.

A barrier 110 separates target areas 108A and 108B from other components of printing module 30-1 to limit the extent to which any airborne or other environmental contaminants can enter into printing module 30-1. For example, in various embodiments, barrier 110 is a barrier to water vapor or other evaporates, as well as inks, paper fragments, colorants, dust, dirt or other foreign materials. Optionally, barrier 110 can also act as a thermal barrier to limit the extent to which heat from the target areas 108A and 108B can enter into printing module 30-1. In the embodiment illustrated in FIG. 6 barrier 110 is shown in the form of a plate having passageways 124A and 124B extending from a first surface 120 on one side of barrier 110 to a second surface 122 on another side of barrier 110. These passageways 124A allow ink to pass through barrier 110.

In some embodiments, this is done by positioning faces 106A and 106B through passageways 124A and 124B so that faces 106A and 106B protrude from passageways 124A and 124B. In other embodiments, faces 106A and 106B can be even or generally even with second surface 122, and in still other embodiments faces 106A and 106B can be positioned between second surface 122 and first surface 120. In further embodiments, faces 106A and 106B can be positioned behind barrier 110.

In the embodiment that is illustrated here, barrier 110 provides a support for inkjet printheads 100A and 110B, however this is not necessary.

As is shown in FIG. 6 first cap 130A has a first shield 132A that is positioned between printhead 100A and a target area 108A. This creates a first shielded region 134A between a face 106A of printhead 100A and shield 132A and a first printing region 136A between first shield 132A and a target area 108A through which receiver 24 is moved during printing. A second shield 132B is positioned between printhead 100B and a target area 108B. This creates a second shielded region 134B between a face 106B of printhead 100B and shield 132B and a second printing region 136B between second shield 132B and a target area 108B through which receiver transport system 40 also moves receiver 24 during printing. First caps 130A. and second caps 130B are, in this embodiment, exemplary of other instances of first caps 130A and second caps 130B that may be found on a first print line 123 and a second print line 125 respectively.

In other embodiments, at least one printhead 100A and cap 130A are arranged along first print line 123 and at least one printhead 100B and cap 130B are arranged along second print line 125. In still other embodiments, at least three printheads are provided with at least one printhead of the at least three printheads arranged along first print line 123 and at least one of the at least three printheads arranged along second print line 125. In still other embodiments a plurality of printheads 100 can be provided with caps 130 with a first portion of the plurality arranged along first print line 123 as printheads 100A and caps 130A and a second portion of the plurality of printheads 100 and caps 130 arranged along second print line 125 as printheads 100B and caps 130B.

First shield 132A and second shield 132B are non-porous and serve to prevent condensation from accumulating on faces 106A and 106B of printheads 100A and 100B. Shields 132A and 132B also provide some protection from physical damage to inkjet printheads 100 and barrier 110 that might be caused by an impact of receiver 24 against a face 106A of printhead 100A, against a face 106B of printhead 100B or against barrier 110. First shield 132A and second shield 132B can take the form of plates or foils and films.

Generally, shields 132A and 132B span at least a width dimension and a length dimension over nozzle arrays 104A and 104B of printheads 100A and 100B. Shields 132A and 132B therefore provide surface area that is relatively large compared to a small thickness that is, for example, on the order of about 0.3 mm. In other embodiments, first shield 132A and second shield 132B can have a thickness in the range of about 0.1 mm to 1 mm.

In certain embodiments, shields 132A and 132B can have a low heat capacity so that a temperature of shields 132A and 132B will rise or fall rapidly and in a generally uniform manner when heated or otherwise exposed to energy from an energy source and otherwise will act to rapidly approach an ambient temperature. In certain circumstances, this ambient temperature will be below a condensation temperature of the vaporizable carrier fluid in printing regions 136A and 134B. This creates a risk that condensation will form on shields 132A and 132B.

Accordingly, shields 132A and 132B are actively heated so that they remain at a temperature that is at or above the condensation temperature of any vaporized carrier fluid 116 in printing regions 136A and 136B. Increasing the temperature of shield 132 reduces or prevents condensation from forming and accumulating on a face 140 of shield 132 that faces target area 108.

Shield 132 can be made of a material having a high thermal conductivity, such as aluminum or copper. The high thermal conductivity of such an embodiment of shield 132 helps to distribute heat more uniformly across shields 132A and 132B so that the temperature of shields 132A and 132B maintain a generally uniform temperature to reduce the risk that condensation will form on localized regions of lower temperature of shields 132A and 132B. Optionally shields 132A and 132B can be made from a non-corrosive material such as a stainless steel.

To prevent condensation from forming on shields 132A and 132B, shields 132A and 132B can optionally have a higher emissivity (e.g., greater than 0.75) to better absorb thermal energy. For example, shields 132A and 132B optionally can be made having a black color and optionally can have an anodized or matte finish to enhance absorption. Alternatively, shields 132A and 132B can be another dark color. Absorption of the thermal energy radiating onto shields 132A and 132B can passively increase the temperature of shields 132A and 132B to reduce an amount of energy required to actively heat the shields 132A and 132B above the condensation temperature of vaporized carrier fluid 116.

Alternatively, other embodiments shields 132A and 132B can be made of a material having a lower thermal conductivity, such as for example, a ceramic material. In still other embodiments, shield 132 can be made from any of a stainless steel, a polyamide, polyimide, polyester, vinyl and polystyrene, and polyethylene terephthalate.

As is illustrated in FIGS. 5 and 6, shields 132A have an opening 138A through which nozzle arrays 104A can jet ink droplets 102A to target area 108A and shields 132B have an opening 138B through which nozzle arrays 104B can jet ink droplets 102B to target area 108B. In FIGS. 5 and 6, openings 138A and 138B are sized to provide a path for ink droplets 102A and 102B to travel to target areas 108A and 108B.

In one embodiment, openings 138A and 138B can be shaped or patterned to closely correspond to an arrangement of nozzle arrays 104A and 104B in an inkjet printing module such as inkjet printing module 30-1. One example of this type is illustrated in FIGS. 7 and 8 which respectively illustrate a bottom perspective view of another embodiment of condensation control system 118 and a schematic sectional view taken as shown in FIG. 7.

Figure 7:
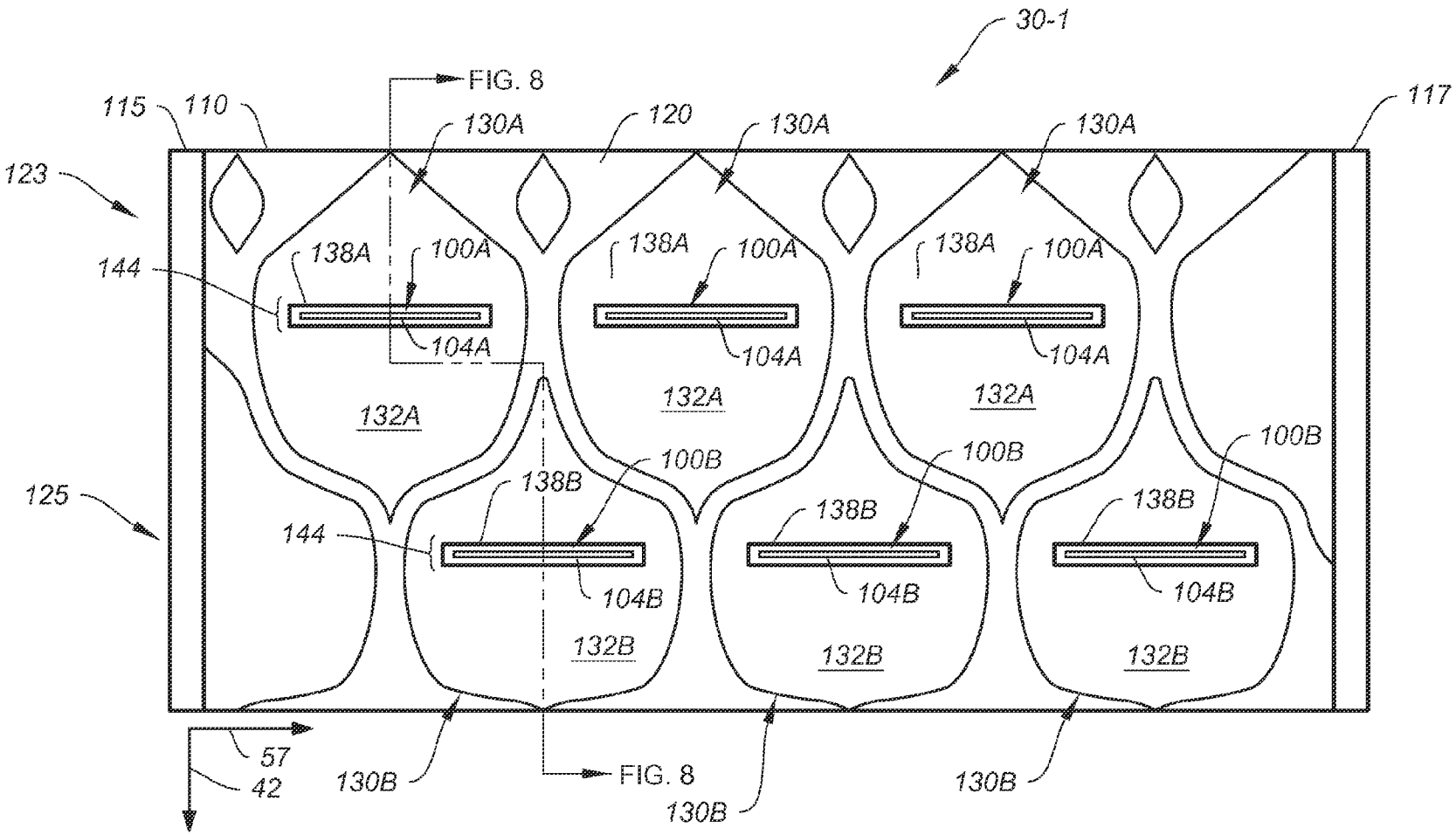
Figure 8:
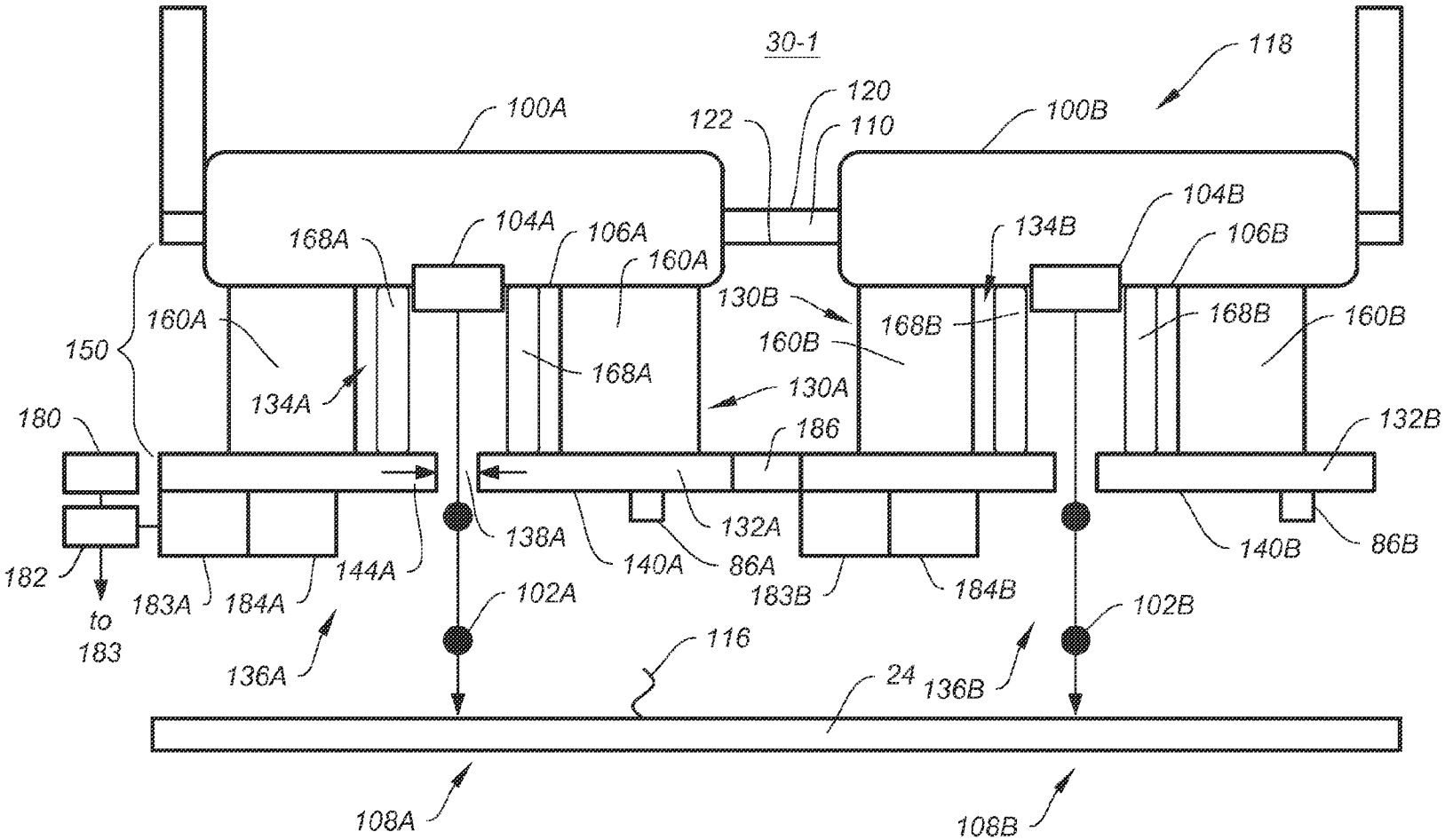
FIG. 8 shows another embodiment of a condensation control system of an inkjet printing system.

As is shown in FIG. 7, shields 132A and 132B have openings 138A and 138B that provide a path for ink droplets (not shown) that are ejected from the nozzle arrays 104A and 104B to pass through shields 132A and 132B.

In the embodiment of FIG. 7, openings 138A and 138B are sized and shaped to help to limit the extent to which vaporized carrier fluid 116 can reach shielded regions 134 from printing regions 136 while not interfering with the transit of ink droplets 102 through openings 138. In one embodiment, this is done by providing that openings 138 have a size in a smallest cross-sectional distance 144 that is calibrated to limit the extent to which vaporized carrier fluid 116 from printing regions 136A and 136B can reach shielded regions 134A and 134B respectively. In this example, openings 138A and 138B shown in FIGS. 7 and 8 extend for a comparatively long distance in one cross sectional distance along width direction 57 in order to accommodate the length of nozzle arrays 104A and 104B. However, openings 138A and 138B need extend only a short distance along the direction of receiver movement 42 to accommodate the transit of ink droplets through openings 138A and 138B, and, in this example therefore the smallest cross-sectional distance 144 is along direction of receiver movement 42.

In general, it will be appreciated that the amount of vaporized carrier fluid 116 that enters first shielded regions 134A and 134B is best limited by providing openings 138A and 138B with a smallest cross-sectional distance 144 that is highly restrictive without negatively influencing drop transit. Accordingly, in some embodiments, smallest cross-sectional distance 144 of openings 138A and 138B can be defined as a function of a size of an ink droplet 102A and 102B such as 150 times the size of an average weighted diameter of ink droplets 102A and 102B ejected by an inkjet printhead 100. For example, in one embodiment, the smallest distance can be on the order of less than 300 times an average diameter of ink droplets while in other embodiments, the smallest cross-sectional distance 144 of an opening 138 can be on the order of less than 150 times the average diameter of ink droplets 102 and, in still other embodiments, the smallest cross-sectional distance 144 of an opening 138 can be on the order of about 25 to 70 times the average diameter of a diameter of ink droplets 102A and 102B.

In other embodiments, a smallest cross-sectional distance 144 of an openings 138A and 138B can be determined based upon the expected flight envelope of ink droplets 102A and 102B as ink droplets were to travel from nozzle arrays 104A and 104B to target areas 108A and 108B. That is, it will be expected that ink droplets 102A and 102B will travel nominally along a flight path from nozzle arrays 104A and 104B to target areas 108A and 108B and that there will be some variation in a flight path of any individual ink droplet 102A and 102B relative to the nominal flight path and that the expected range of variation can be predicted or determined experimentally and can be used to define a smallest cross-sectional distance 144 of one or more opening 138A and 138B such that an opening 138A and 138B has a smallest cross-sectional distance 144 that does not interfere with the flight of any inkjet droplet from a nozzle arrays 104A and 104B to target areas 108A and 108B.

Returning now to FIG. 6, shields 132 are shown positioned at separation distances 150A and 150B from faces 106A and 106B using thermally insulating separators 160A and 160B. In the embodiment that is shown in FIG. 6, thermally insulating separators 160A and 160B extend from second surface 122 barrier 110 and are used to hold shields 132A and 132B in fixed relation to second surface 122. Thermally insulating separators 160A and 160B can alternatively be joined to faces 106A and 106B of printheads 100A and 100B as is shown in FIGS. 7 and 8.

Thermally insulating separators 160A and 160B can be permanently fixed to faces 106A and 106B, to barrier 110 or to shields 132A and 132B using adhesives, welding, and mechanical fasteners and the like. Thermally insulating separators 160A and 160B can also integrally formed with shields 132A and 132B and can for example be formed from a common substrate.

In other embodiments, thermally insulating separators 160A and 160B can be removably mounted to faces 106A and 106B, to barrier 110 or to shields 132A and 132B. For example, in one embodiment, thermally insulating separators 160A and 160B can comprise magnets that are joined to selected regions of shield 132A and 132B. In other embodiments, shields 132A and 132B is positioned between barrier 110 and target areas 108A and 108B by a plurality of thermally insulating separators 160A and 160B. Such a plurality of thermally insulating separators 160A and 160B can take the form of pins, bolts, or other forms of connectors that in combination form a perimeter for caps 130A and 130B that substantially or completely resists airflow into shielded regions 134A and 134B.

Thermally insulating separators 160A and 160B can be made to be thermally insulating through the use of thermally insulating materials including but not limited to air or other gasses, Bakelite, silicone, ceramics or an aerogel based material. Thermally insulating separators 160A and 160B can also be made to be thermally insulating by virtue a shape or configuration, such as by forming thermally insulating separators 160A and 160B to have a tubular construction or other construction that provides, for example, a relatively large surface area as opposed to cross-sectional area or that has other features that allow thermally insulating separators 160A and 160B to radiate. In one embodiment of this type, a poor thermal insulator such as stainless steel can be made to act as a thermal insulator by virtue of assembling the stainless steel in a tubular fashion. Optionally, both approaches can be used.

Separation distances 150A and 150B create a shielded regions 134A and 134B that provide air gap 139 between faces 106A and 106B and shields 132A and 132B. Air gap 139 provides additional thermally insulation between, shields 132A and 132B and faces 106A and 106B to allow shields 132A and 132B to have a temperature that is greater than a temperature of faces 106A and 106B without heating printheads 100A and 100B to an unacceptable level. While a larger air gap 139 between faces 106A and 106B and shields 132A and 132A provides a desirable level thermal insulation, this is not mandatory and air gap 139 does not need to be large. To keep the flight path from nozzle arrays 104A and 104B to target areas 108A and 108B small, which is desired for maintaining the best print quality, air gap 139 should be kept small. In one embodiment, air gap 139 is between about 0.5 and 5.0 mm tall however, other sizes are possible and may be more useful or practical for particular machine configurations.

Thermally insulating separators 160A and 160B can have a fixed size to define a fixed separation or can vary with temperature so that a greater air gap 139 is provided when conditions are hotter. In one embodiment, thermally insulating separators 160A and 160B can incorporate a material that is thermally expansive so that thermally insulating separators 160A and 160B expand the extent of separation distances 150A and 150B between either or both of shields 132A and 132B and barrier 110 in response to any of an increase in a temperature of matter that is in contact with the thermally expansive thermally insulating separators 160A and 160B such as contact with faces 106A and 106B, second surface 122, shields 132A and 132B or air in printing regions 136A or 136B.

The thermal insulation provided by air gap 139 in turn allows shields 132A and 132B to be actively heated to a temperature that is above a condensation point for the vaporized carrier fluids in printing regions 136A and 136B while allowing printheads 100A and 100B to remain at cooler temperatures, including, in some embodiments, temperatures that are below a condensation temperature of the vaporized carrier fluids in printing regions 136A and 136B.

It will be appreciated however that the condensation temperature in a first printing region 136A can differ significantly from the condensation temperature in a second printing region 136B. This can occur for a variety of reasons. For example, first printing region 136A and second printing region 136B can have different concentrations of vaporized carrier fluid 116, different temperatures, different heating or cooling rates, printing loads, printhead temperatures, and different exposure to factors such as ambient humidity, airflow, receiver temperature, printhead temperature, variations in an amount of ink used for printing. These conditions can also change rapidly and dynamically across a plurality of printheads in the printing module.

Accordingly, in the embodiment illustrated in FIGS. 5 and 6, an energy source 180 and a control circuit 182 are provided respectively to make energy available energy to heat shields 132A and to control the extent to which each the available energy is supplied to the shield 132A and to 132B so that shields 132A and 132B can be heated to different temperatures. This allows condensation to be controlled while also limiting the risk of overheating or underheating.

There are a number of ways in which this can be done. In one embodiment, energy source 180 supplies electrical energy and control circuit 182 includes logic circuits that determine an extent to which electrical energy is supplied to a first electrical heater 172A that causes first shield 132A to heat and a second electrical heater 172B that causes the second shield 132B to heat. Control circuit 182 controls the transfer of electrical energy to first electrical heater 172A and separately controls the transfer of electrical energy to second electrical heater 172B. In one embodiment, electrical heaters 172A and 172E are in the form of resistors or other known circuits or systems devices that convert electrical energy into heat. In certain embodiments, electrical heaters 172A and 172B can comprise a thermoelectric heat pump or "Peltier Device" that pumps heat from one side of the device to another side of the device. Such a thermoelectric heat pump can be arranged, for example, to pump heat from a side 142A of shield 132A confronting first printing region 136A to a side 143A of shield 132A that is in contact with thermally insulating separators 160A and shielded regions 134A. Such electrical heaters 172A and 172B can be joined to shields 132A and 132B or shields 132A and 132B can be made from a material or comprise a substrate that can heat in response to applied electrical energy.

In a further embodiment, energy source 180 can comprise a heater that heats a plurality of contact surfaces that are in contact with shields 132A and 132B and control circuit 182 can control an actuator in energy source 180 such as a motor that controls an extent of contact between shields 132A and 132B and the contact surface or can control an amount of heat supplied by the energy source to each of the contact surface.

In another embodiment of, thermally insulating separators 160A and 160B can be made of materials that expand when subject to a change in electromagnetic fields about the materials and in such embodiments, an electro-magnetic signal can be provided by a control circuit 182 cooperate with a energy source 180 to create appropriate electromagnetic conditions to induce expansion or contraction of the thermally insulating separators 160A and 160B. For example, in one embodiment of this type, thermally insulating separators 160A and 160B that are formed from a material that expands when exposed to electrical energy can be connected in series with electrical heaters 172A and 172B such that whenever power is applied to electrical heaters 172A and 172B, such electrical power also is applied to thermally insulating separators 160A and 160B causing thermally insulating separators 160A and 160B increase the gap between shields 132A and 132B and printheads 100A and 100B.

It will be appreciated that in other embodiments, caps 130A and 130B can be attached to printheads 100 as shown in FIG. 5, or alternatively, caps 130A and 130B can be attached to barrier 110 at mounting points adjacent to printheads 100A and 100B. Attachment of shields 132A and 132B to printheads 100A and 100B respectively enables the use of smaller shields 132.

Attachment of caps 130A and 130B to barrier 110 can allow smaller separation distances between faces 106 of printheads 100 and shields 132A and 132B. For example, in some embodiments where printheads 100A and 100B are mounted to barrier 110, printheads 100A and 100B can be recessed relative to faces 106A and 106B of printheads 100A and 100B. This approach also enables printheads 100A and 100B to have greater thermal isolation from shields 132A and 132B.

FIG. 8 illustrates another embodiment of an energy source 180 and control circuit 182. In this embodiment energy source 180 provides separate flows of a heated medium that contact different ones of the shields and that individually heat the different ones of the shield. In this embodiment, control circuit 182 controls the extent of each separate flow in order to control the heating of the separate shields. For example, as is shown in FIG. 8, energy source 180 supplies energy to a first heater 183A that heats air or another gas that is fed into printing regions 136A by a blower 184 to heat both ink droplets 102 and first shield 132A as well as a second heater 183B that heats air or another gas that is fed into printing regions 134B by a second blower 184B. It will be appreciated that the amount of gas fed in this manner will be limited so as not to disturb the travel of ink droplets 102. A separator 186 is positioned between first printing region 136A and second printing region 136B and can include a vacuum return to draw heated gasses as well as a portion of vaporized carrier fluid 116 in first printing region 136A and a portion of vaporized carrier fluid 116 in second printing region 136B from printhead 100A and 100B. Control circuit 182 can control the extent of the flows of heated air caused by these systems by way of controlling an amount of energy supplied to first blower 184A and second blower 184B. Alternatively, the embodiment of FIG. 8 can also provide a radiation source such as a source of electro-magnetic radiation that is absorbed by shields 132A and 132B causing shields 132B to increase in temperature.

Any other known mechanism and control system that can be combined to permit controlled heating of adjacent but thermally isolated surfaces can be used toward this end. Control circuit 182 can take any of a variety of forms of control circuits known in the art for controlling energy supplied to heating elements. In one embodiment, printing system controller 82 can be the control circuit. In other embodiments, control circuit 182 can take the form of a programmable logic executing device, a micro-processor, a programmable analog device, a micro-controller or a hardwired combination of circuits made cause printing system 20 and any components thereof to perform in the manner that is described herein.

The heating of shields 132A and 132B can be uniform or patterned. In one embodiment of this type, a heater 172 can take the form of a material that heats when electrical energy is applied and that is patterned to absorb applied energy so that different portions of shield 132 heat more than other portions in response to applied energy. This can be done for example, and without limitation, by controlled arrangement or patterning of heaters 172 on shields 132A and 132B. Such non-uniform heating of shields 132A and 132B can be used for a variety of purposes. In one embodiment, shields 132 can be adapted to heat to a higher temperature away from respective openings 138 than proximate to openings 138.

It will be appreciated from the foregoing that portions of shield 132A and 132B are located between portions of the face of the printheads 100A and 100B and target areas 108A and 108B to limit the extent to which vaporized carrier fluid 116 passes from printing regions 136A and 136B to shielded regions 134A and 134B. In certain embodiments, this also advantageously limits the extent to which any radiated energy can directly impinge upon the faces 106A and 106B of the printheads 100A and 100B.

In the embodiment illustrated in FIG. 8, heating of first printing region 136A and second printing region 136B is controlled through a feedback system in which control circuit 182 uses signals from sensors 86A and 86B to detect conditions in printing regions 136A and 136B as a basis for generating signals that control an amount of energy supplied by energy source 180 so as to dynamically control the heating of shield 132. FIG. 8 illustrates one embodiment of this type having sensor 86A and 86B positioned in printing regions 136A and 136B and operable to generate a signal that is indicative of as a ratio of the partial pressure of carrier fluid vapor in an air-carrier fluid mixture in printing regions 136A and 136B to the saturated vapor pressure of a flat sheet of pure carrier fluid at the pressure and temperature of printing regions 136A and 136B. The signals from sensor 86A and 86B are transmitted to control circuit 182. Control circuit 182 then controls an amount of energy supplied by the energy source 180 to heat the shields 132A and 132B according to the relative humidity in the printing regions 136A and 136B.

In another embodiment, sensors 86A and 86B can comprise a liquid condensation sensor located proximate to shields 132A and 132B and that are operable to detect condensation on faces 140A and 140B of shields 132A and 132B. Sensors 86A and 86B are further operable to generate a signal that is indicative of the liquid condensation, if any, that is sensed thereby. The signals from sensors 86A and 86B is transmitted to control circuit such as printing system controller 82 so that printing system controller 82 can control an amount of energy supplied by energy source 180 to cause shields 132A and 132B to heat according to the sensed condensation.

In still another embodiment, sensors 86A and 86B can comprise temperature sensors located proximate to shields 132A and 132B operable to detect a temperature of shields 132A and 132B and further operable to generate a signal that is indicative of the temperature of shields 132A and 132B. The signal from sensors 86A and 86B can be transmitted to control circuit such as printing system controller 82 so that control circuit 182 can control an amount of energy supplied by energy source 180 to cause shields 132A and 132B to heat according to the sensed temperature.

In yet another embodiment, sensors 86A and 86B can comprise receiver temperature sensors that are operable to detect conditions that are indicative of a temperature of receiver 24 such as an intensity of infra-red light emitted by receiver 24 and further operable to generate a signal that is indicative of temperature of receiver 24. The signal from receiver temperature sensors 86A and 86B can be transmitted to a control circuit 182 such as printing system controller 82 so that control circuit 182 can control an amount of energy supplied by energy source 180 to cause shields 132A and 132B to heat according to the sensed temperature of receiver 24 when receiver 24 is in first printing region 136A and in second printing region 136B.

As is shown in the embodiment of FIG. 8, shields 132A and 132B can have optional seals 168 to seal between shields 132A and 132B and at least one of barrier 110 and face 106 of printheads 100. Seals 168 can be located to further restrict the transport of vaporized carrier fluid 116 near printhead 100 and barrier 110 and can be positioned along a perimeter of a shield 132, and also around the perimeter of the opening 138. By sealing around the edges of the shield, air flow through air gap 139 is restricted, which enhances the thermal insulation value of air gap 139. Such seals 168 should also be provided in the form of thermal insulators and in that regard, in one embodiment the thermally insulating separators 160A and 160B can be arranged to provide a sealing function.

Figure 9:
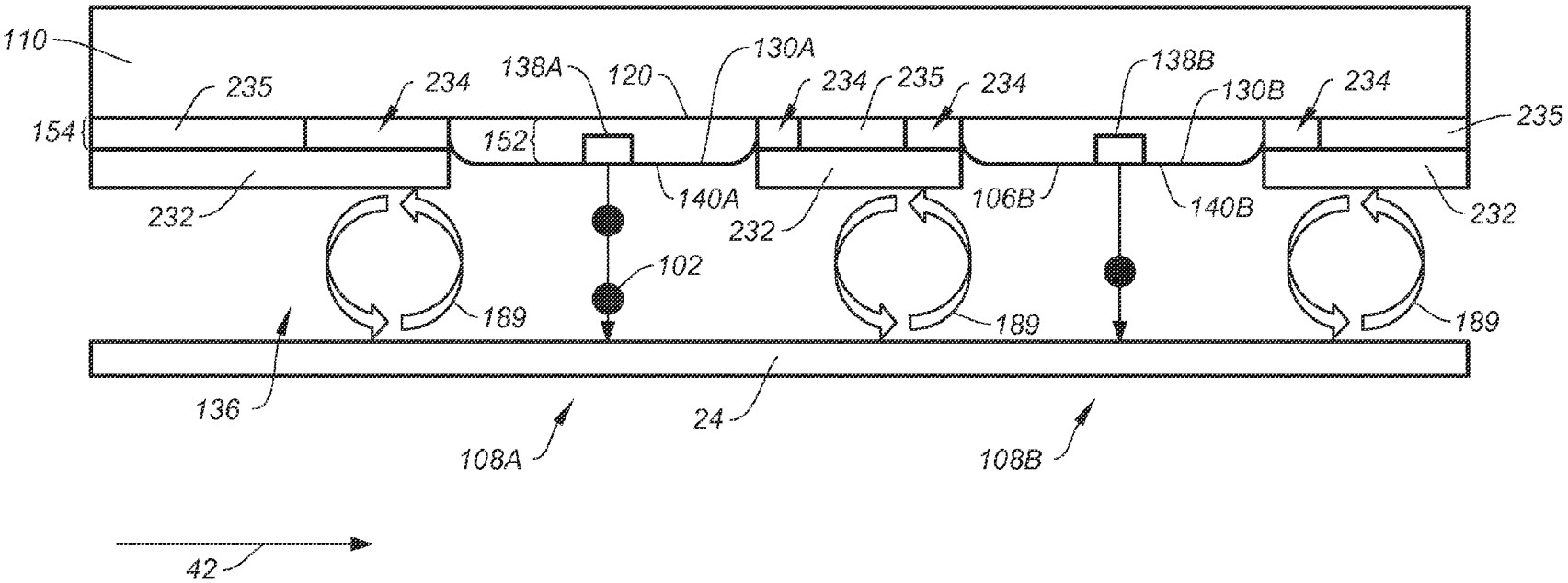
FIGS. 9, 10 and 11 illustrate another embodiment of a condensation control system for an inkjet printing system.
Figure 12:
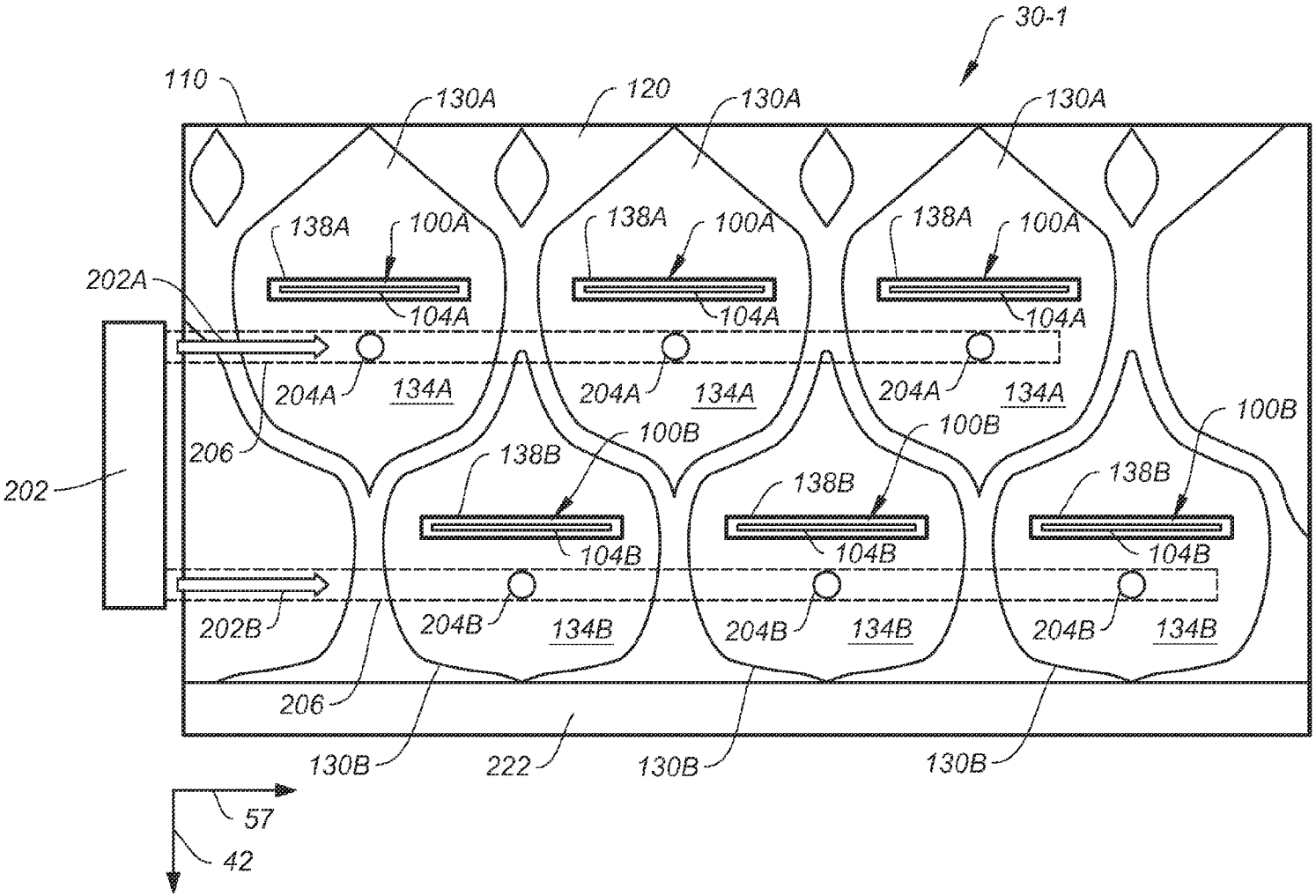
FIG. 12 shows still another embodiment of a condensation control system for an inkjet printing system.

FIG. 9 illustrates another embodiment of a condensation control system 118 for an inkjet inkjet printing system 20. In this embodiment, caps 130A and 130B have faces 140A and 140B of shields 132A and 132B apart from first surface 120 of barrier 110 by a projection distance 152. As is also shown in FIG. 12, an optional a supplemental shield 232 is positioned apart from first surface 120 by thermally insulating separators 235. This creates an insulating area 234 between supplemental shield 232 and first surface 120. In one embodiment, air or another medium can be passed through insulating area 234 to prevent condensate build up and to reduce temperatures.

Supplemental shields 234A and 234B are positioned apart from second surface 122 of barrier 110 by separation distances 154A and 154B that are less than projection distances 152A and 152B of caps 130A and 130B. Preferably, supplemental shields 232A and 232B are sealed or substantially sealed against caps 130A and 130B to limit the transit of vaporized carrier fluid 116 into shielded regions 134A and 134B.

Supplemental shields 232A and 232B can be heated by convection flows of air 189 heated by receiver 24 to an elevated temperature. This can reduce the possibility that vaporized carrier fluids will condense against supplemental shield 232. Optionally, supplemental shields 232 can be actively heated in any of the manners that are described herein. Supplemental shields 232 can also be made in the same fashion and from the same materials and construction as shields 132A and 132B.

Figure 10:
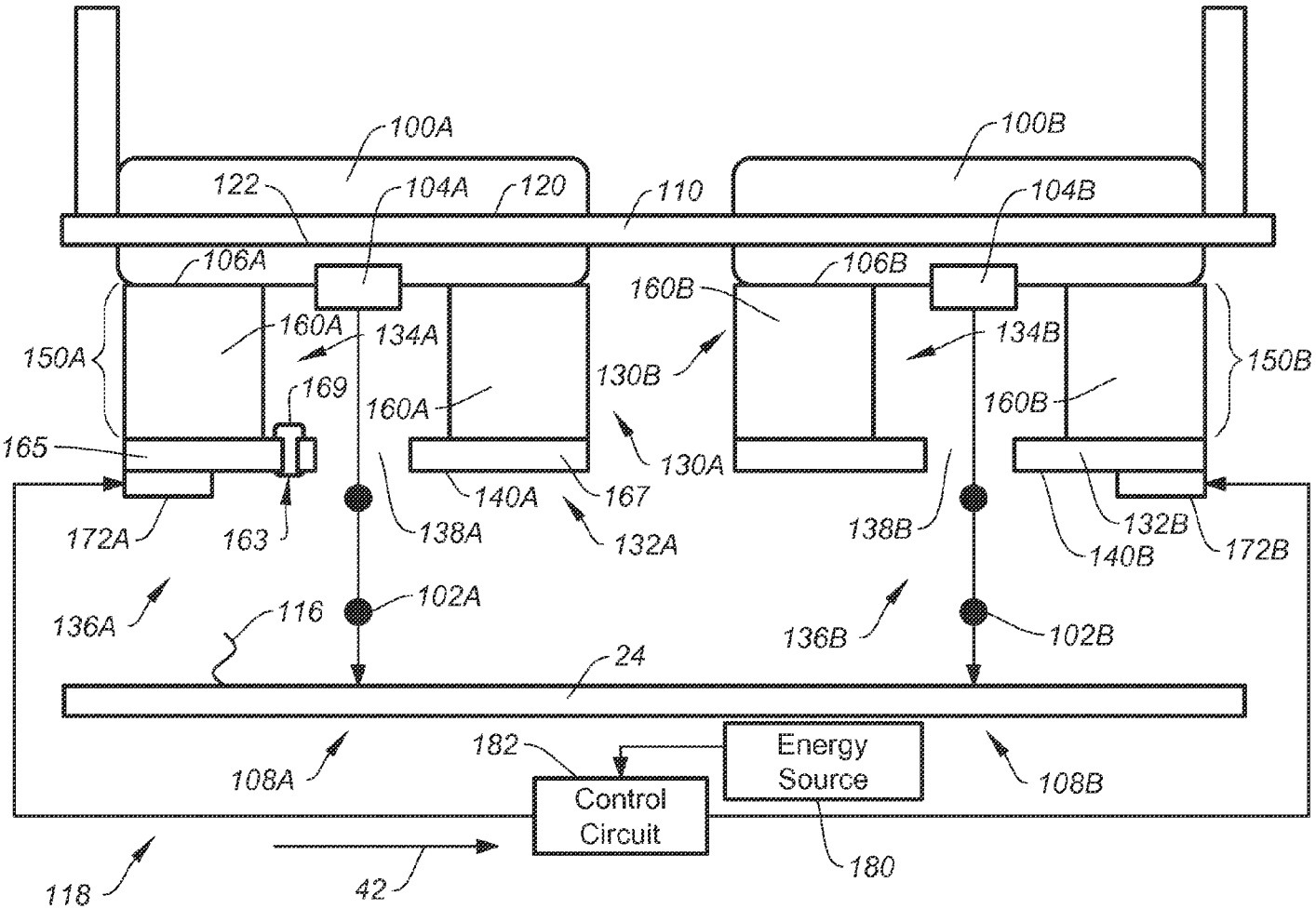

FIG. 10 shows another embodiment of a condensation control system 118 for an inkjet printing system 20. As is shown in this embodiment, first cap 130A has a multi-part first shield 132A including a first shield part 165 of first shield 132A supported by a first part 171 of thermally insulating separator 160A and a second shield part 167 of first shield 132A supported by a second part 173 of thermally insulating separator 160A. Shield parts 165 and shield part 167 can have corresponding or different responses to energy and can be controlled by a common control signal or a shared energy supply or by individual control signals or energy supplies.

In the embodiment that is illustrated in FIG. 10, shield part 165 and shield part 167 are optionally linked by way of an expansion joint 163 that allows shield parts 165 and 167 to expand and to contract with changes in temperature without creating significant stresses at thermally insulating separator 160A and without creating a path between shield parts 165 and 167 that is sufficient to allow vaporized carrier fluid 116 to enter first shielded region 134A in an amount that is sufficient to create condensation within first shielded region 134A. Here expansion joint 163 is illustrated generally as including an expandable material 169 linking first shield part 165 and second shield part 167 in a manner that maintains a seal between the parts. In certain embodiments of this type expansion joint 163 can take the form of a stretchable tape or a stretchable or compressible adhesive or polymer.

In still another embodiment, first shield 132A can comprise a flexible or bendable sheet that is held in tension by the thermally insulating separator 160 with the thermally insulating separator 160 acting as a frame.

Alternatively, first shield 132A can be adapted to change dimension in a manner that accommodates changes in dimension of barrier 110 and inkjet printheads 100 due to heating or cooling.

In still another embodiment first shield 132A can be joined to thermally insulating separator 160A in a manner that allows first shield 132A and thermally insulating separator 160A to move relative to each other to accommodate change in dimension of the barrier 110, inkjet printheads 100 due to heating or cooling. This can be done for example where first shield 132A and thermally insulating separator 160A are magnetically joined to each other or where thermally insulating separator 160A is magnetically joined to barrier 110. In one example of this, thermally insulating separator 160A can comprise a magnet such as a ceramic magnet or a polymeric magnet while barrier 110 and shield 132A can be made from or made to incorporate magnetic materials. It will be appreciated that in other embodiments second cap 130B can likewise incorporate any of the features described herein with reference to shield 132A.

Figure 11:
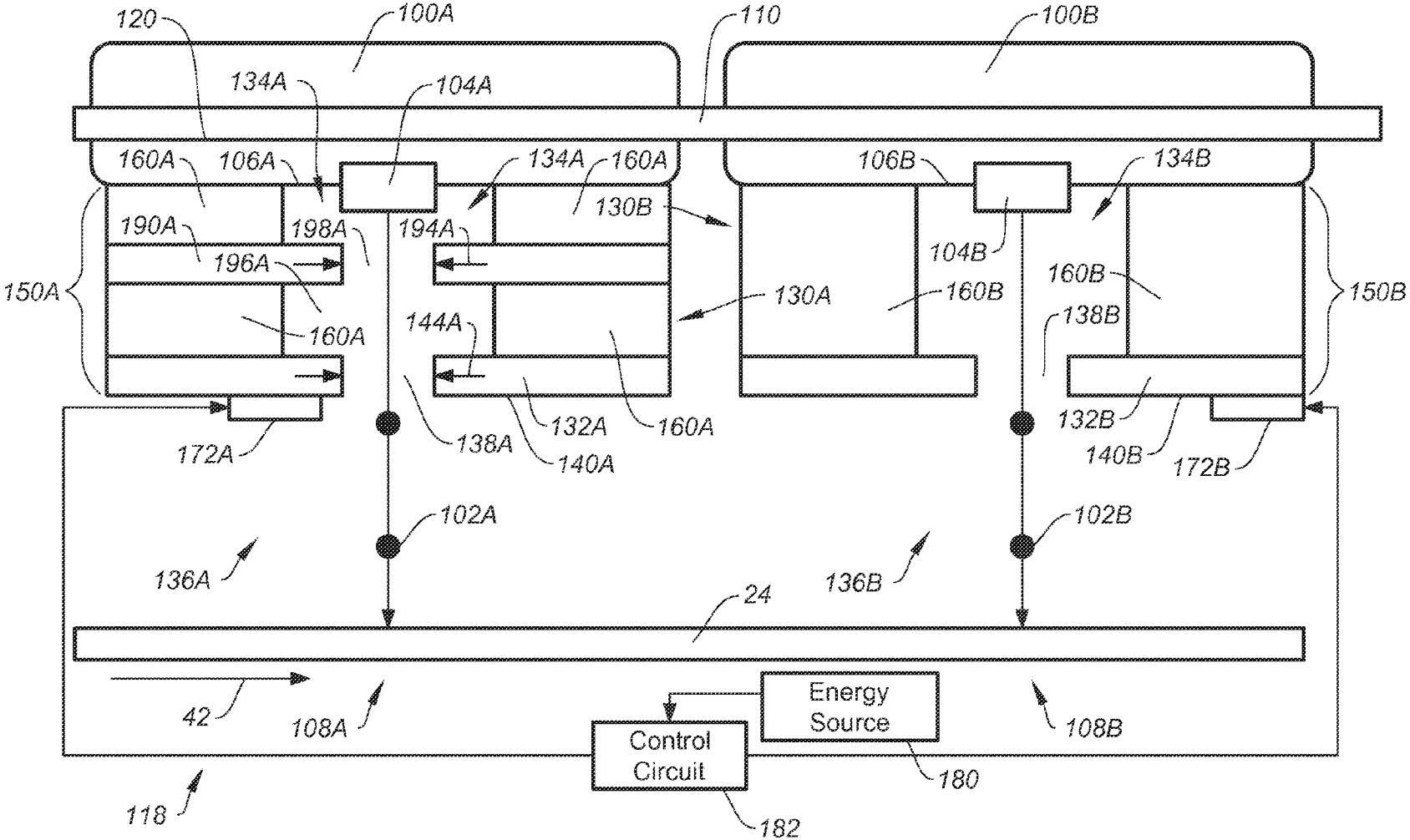

FIG. 11 shows another embodiment of a condensation control system 118 for an inkjet printing system 20. As is shown in this embodiment, condensation control system 118 has a first cap 130A with an intermediate shield 190A to define an intermediate region 196A joined to first shielded region 134A by way of an intermediate opening 198A through which ink droplets 102 can be jetted. Intermediate shield 190A has an intermediate opening 198A. In one embodiment, intermediate opening 198A can match opening 138A such as by having a smallest cross-sectional distance 194A for intermediate opening 198A that is substantially similar to a smallest cross-sectional distance 144A of opening 138A in first shield 132A. Alternatively, the shapes and sizes of intermediate opening 198A in intermediate shield 190A can be different than those of openings 138A in first shield 132A. In one embodiment, intermediate opening 198A can be shaped or patterned to correspond to an arrangement of nozzle arrays 104 in an inkjet printing module such as inkjet printing module 30-1. Intermediate opening 198A in intermediate shield 190 also can be defined independent of opening 138A in first shield 132A. Intermediate shield 190A divides first shielded region 134A into two parts to further reduce the extent to which air having vaporized carrier fluid 116 can travel from target area 108A to printhead 100A and can also be used to further protect printhead 100A from any heat generated by first shield 132A such as when first shield 132A is heated by first electrical heater 172A. Although not illustrated in FIG. 11, the features of first cap 130A described in FIG. 11 can be incorporated into second cap 130B.

Figure 13:
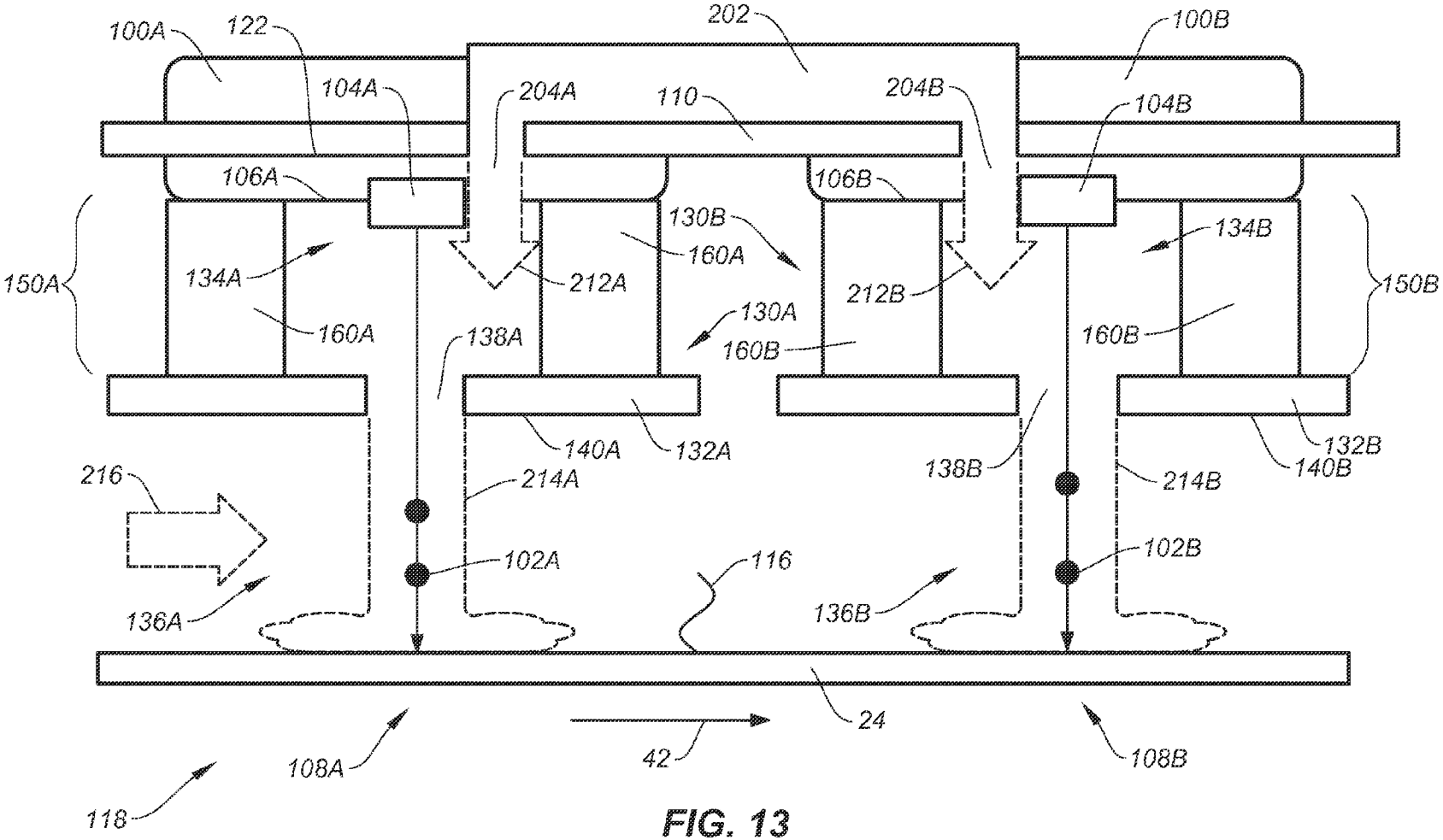
FIG. 13 shows a further embodiment of a condensation control system for an inkjet printing system.

FIGS. 12 and 13 illustrate another embodiment of a condensation control system 118 that can be used with an inkjet printing module 30-1. As is shown in FIG. 12, in this embodiment, barrier 110 provides a blower output 204 into shielded regions 134A and 134B, between barrier 110 and caps 130A and 130B. Openings 204A and 204B are connected by way of a manifold or other appropriate ductwork 206 (shown in phantom) to a cap blower 202 which is controlled by control circuit 182.

As is shown in FIG. 13, in operation, cap blower 202 creates airflows 212A and 212B of air or another gas through optional openings 204A and 204B in barrier 110. Airflows 212A and 212B create positive air pressure in shielded regions 134A and 134B. In this embodiment, caps 130A and 130B are at least sufficiently sealed against shields 132A and 132B, and printhead 100 or barrier 110 such that co-linear airflows 214A and 214B are created from openings 138A and 138B in shields 132A and 132B. It will be appreciated that co-linear airflows 214A and 214B are approximately parallel or co-linear to the path of ink droplets 102A and 102B as ink droplets 102A and 102B travel from printheads 100A and 100B toward target areas 108A and 108B respectively.

Co-linear airflow 214A and 214B can optionally be used to provide one or more of the advantages of: providing greater control over air/ink interactions that influence drop placement, a buffer against the effect of any crossing air flow 216, creating an air cushion that resists movement of receiver 24 toward shields 132A and 132B and providing additional protection against the possibility that receiver 24 will be moved toward and strike shields 132A and 132B. Further, co-linear airflows 214A and 214B can be conditioned by an optional air conditioning system 228 so that co-linear airflows 214A and 214B have any or all of a controlled temperature, pressure, flow rate or humidity to provide controlled environmental conditions in first shielded region 136A and second shielded region 136B and also so that co-linear airflows 214A and 214B have properties that are useful in drying ink that has been applied to receiver 24 or otherwise achieving the effects described herein. In one example, co-linear airflows 214A and 214B can be heated in a manner that is calculated to raise the temperature of shields 132A and 132B.

Condensation Control Using Cross-Module Airflow

Figure 14:
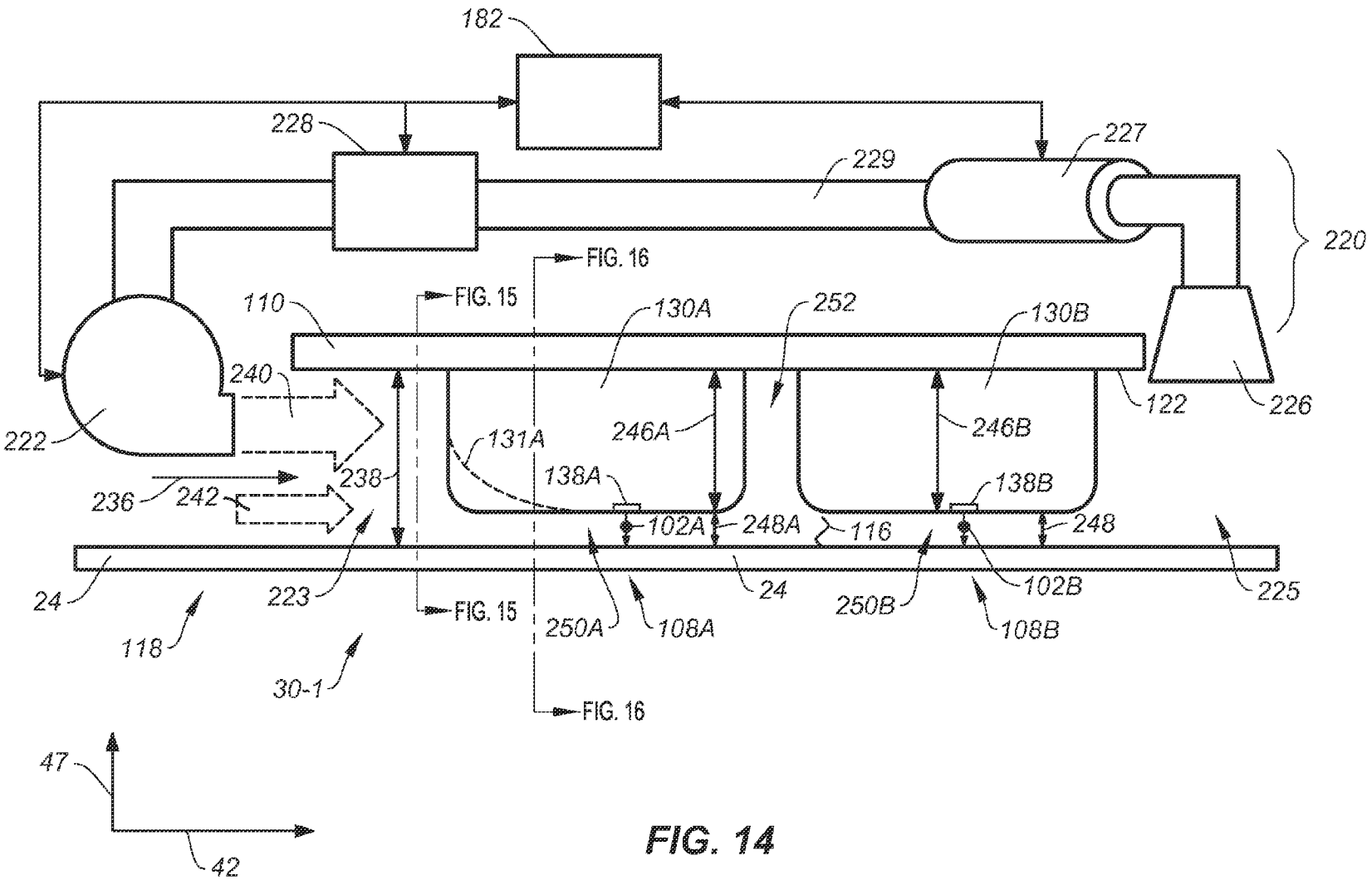
FIGS. 14, 15, 16 and 17 show an embodiment of a condensation control system.
Figure 15:
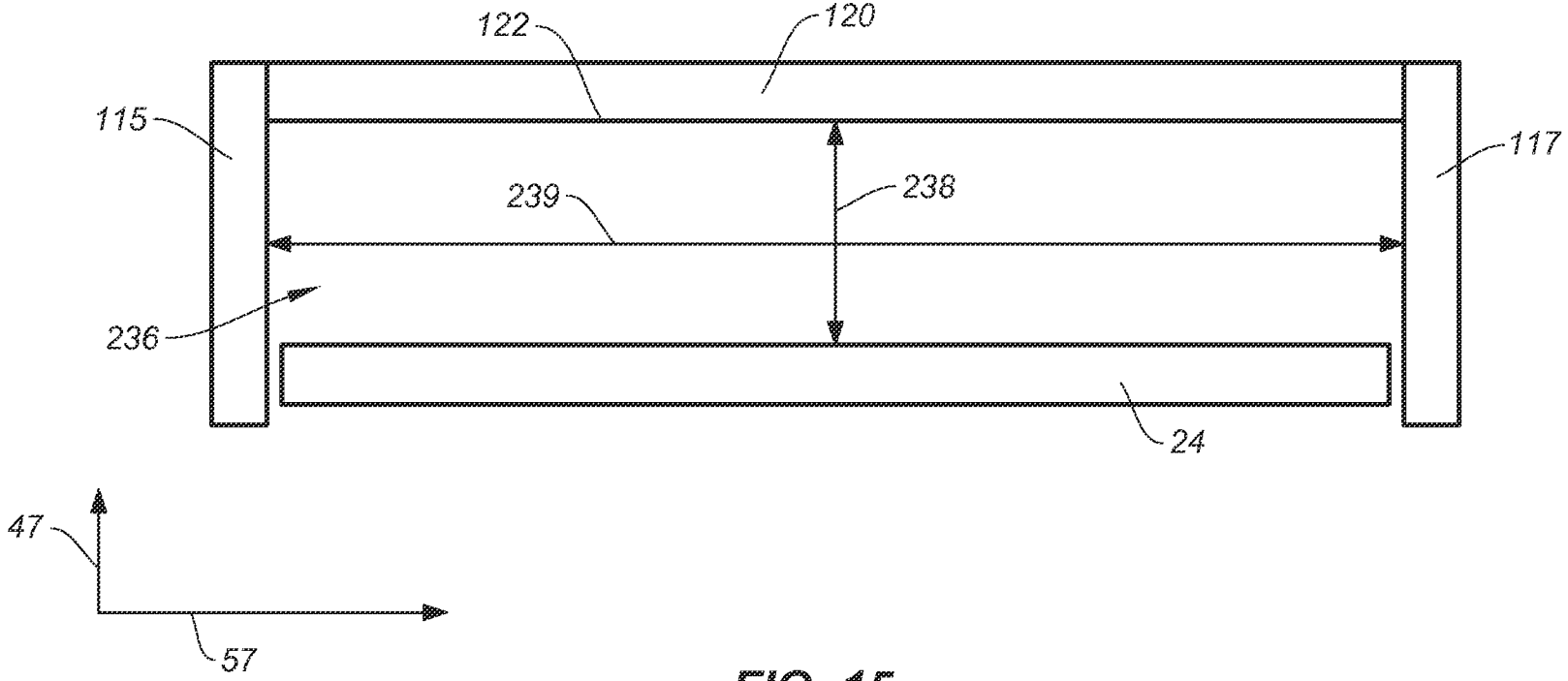
Figure 16:
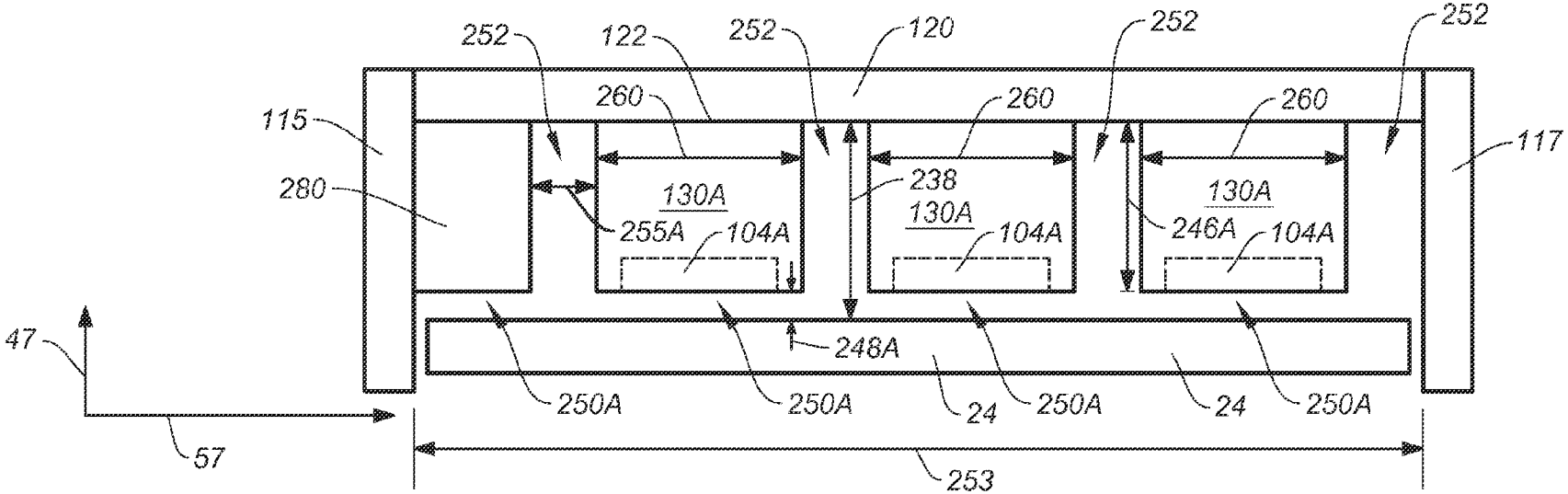

FIGS. 14, 15, and 16 illustrate another embodiment of a condensation control system 118 that is used in connection with printing module 30-1 as is generally described above. FIG. 14 illustrates this embodiment in a side schematic view, while FIGS. 15 and 16 illustrate this embodiment in cross section views taken as illustrated in FIG. 14.

In this embodiment, condensation control system 118 includes barrier 110, caps 130 and a cross-module airflow generation system 220. Cross-module airflow generation system 220 provides a cross-module airflow 240 at an entrance area 223 of a cross-module flow path 236 between receiver 24, barrier 110, caps 130A and 130B to reduce the concentration of vaporized carrier fluid 116. FIG. 14 illustrates caps 130A and 130B. Caps 130A and 130B extend from barrier 110 by cap extension distances 246A and 246B leaving clearance distances 248A and 248B between caps 130A and 130B and receiver 24. Caps 130A and 130B are schematically illustrative of a plurality of caps 130A and 130B extending across a width direction 57 to form a first print line 123 and a second print line 125.

As is also shown in FIG. 14 condensation control system 218 includes a cross-module airflow generation system 220 having a blower 222 that provides a cross-module airflow 240 of air (or other gasses) into an entrance area 223 of a cross-module flow path 236 between printing module 30-1 and target areas 108A and 108B. Cross-module airflow 240 may interact with and incorporate any flow of entrained air 242 that is moving along with receiver 24 as receiver 24 moves into printing module 30-1 and to that extent may mix with the same in whole or in part. Also shown in FIG. 14 is a vacuum port 226 positioned at exit area 225 of cross-module flow path 236 that is connected to a vacuum system 227 that creates a suction at vacuum port 226 and that can optionally filter air sucked into vacuum port 226. The vacuum suction provided by vacuum system 227 and vacuum port 226 can provide some or all of cross-module airflow 240 in certain embodiments. Optionally air that has been vacuumed into port 226 can be recirculated to blower 220 as shown using for example an air duct 229 of any conventional design an can be conditioned before such reuse by filtering or other processing to remove vaporized carrier fluid 116, humidity or other potential contaminants. This can be done in whole or in part at vacuum system 227 or in whole or in part using an air conditioning system 228. Printer controller 182 can control the operation of vacuum Cross-module airflow 240 can be supplied at a rate of between 20 and 100 cubic feet per minute with a preferential flow rate of 25 cubic feet per minute in some embodiments. For example, an inkjet printing system 20 can have a controller such as printing system controller 82 and sensors such as sensors 86 that provide data from which the controller can determine at least two of an expected or measured range of concentrations of a vaporized carrier fluid 116 to be removed by the cross-module airflow 240, expected or measured resistance to cross-module airflow 240 in lower resistance flow channels 252 and higher resistance flow areas 250, expected or measured temperatures of the air between receiver 24 and barrier 110, expected or measured evaporation or condensation temperatures of any vaporized carrier fluid 116, the temperature of the air used in cross-module airflow 240, a temperature of any vaporized carrier fluid 116 in any entrained air 242 moving with receiver 24 during printing, and wherein the controller establishes a rate of cross-module airflow based upon the determined data from the sensors and known differences between the airflow resistance in the higher resistance flow areas 250 and the lower resistance flow channels 252. In one embodiment of this type, printing system controller 82 additionally determine a volume of cross-module airflow to be supplied between the barrier and the receiver based upon at least one of a type of ink to be used in printing, a speed of receiver movement and a range of a volume of ink droplets to be emitted per unit time during printing.

In another embodiment, the relative proportion of cross-module airflow 240 through higher resistance flow areas 250A and 250B to the proportion of cross-module airflow 240 traveling through lower resistance flow channels 252 at a particular flow rate can be determined by printing system controller 82 based upon the resistance to cross-module airflow in the higher resistance flow areas 250A and 250B by clearance distances 248A and 248B between caps 130A and 130B and receiver 24, by the resistance to cross-module airflow 240A in the lower resistance flow channels 252. Here, printing system controller 82 can select a volume of cross-module airflow per unit time based in order to achieve a threshold ratio that will prevent image artifacts from occurring.

FIG. 15 shows a schematic cross-section view of cross-module flow path 236 at entrance area 223 taken as shown in FIG. 14. As is shown in FIG. 15, cross-module flow path 236 has an open cross-sectional entry area 230 into which cross-module airflow (not shown) flows. Thus, the cross-sectional area of entrance area 223 is defined by an entrance distance 238 between second surface 122 of barrier 110 and receiver 24 and a sidewall distance 239 from a first sidewall 115 to a second sidewall 117 along width direction 57.

FIG. 16 shows a cross-section of cross-module flow path 236 also taken as shown in FIG. 14. As can also be seen from FIG. 16, caps 130A have cap widths 260 that extend across cross-module flow path 236 and are separated by cap separation distances 255A. Accordingly, cross-module airflow 240 that enters cross-module flow path 236 by way of entrance area 223 as is shown in FIG. 14 is required to flow between caps 130A or between caps 130A and receiver 24. However, cross-module airflow between caps 130A and receiver 24 is to be limited to reduce the risk that cross-module airflow 240 will cause errors in the placement of ink droplets 102A and accordingly create unwanted image artifacts.

It will be appreciated that cross-module airflow 240 like most other flows will follow the path of least resistance through cross-module flow path 236. Accordingly, in the embodiment of FIGS. 14-16, cross-module airflow 240 is managed by creating higher resistance flow areas 250A and 250B between caps 130A and 130B and receiver 24 and by creating lower resistance flow channels 252 in areas between caps 130A and 130B.

Here higher resistance flow areas 250A and 250B are created by providing regions in which cross-module airflow 240 is required to flow through a small clearance distance 248A and 248B between comparatively large surfaces of caps 130A and receiver 24 and between caps 130B and receiver 24 respectively. Any portion of cross-module airflow 240 entering into clearance distances 248A is likely to contact either or both of cap 130A and receiver 24 and similarly any portion of cross-module airflow 240 entering into clearance distance 248B is likely to contact either or both of cap 130B and receiver 24. This friction creates what is known as a surface drag on such flows. The surface drag resists cross-module airflow 240 creating higher resistance flow areas 250A between caps 130A and receiver 24 and between higher resistance flow areas 250B and receiver 24.

For example as is shown in the embodiment of FIGS. 14-16, caps 130A and 130B are shown separated from receiver 24 in higher resistance flow areas 250A and 250B by clearance distances 248A and 248B that are no greater than a maximum printing distance along which nozzle arrays 104A and 104B can reliably direct ink droplets 102A and 102B for printing on receiver 24. In this embodiment, nozzle arrays 104A and 104B are positioned within caps 130A and 130B. However, caps 130A and 130B and receiver 24 are arranged to create higher resistance flow areas 250A and 250B that begin at positions that are sufficiently upstream of target areas 108A and 108B to protect ink droplets 102A and 102B from unwanted deflection.

In this embodiment, lower resistance flow channels 252 are defined by an entrance distance 238 between second surface 122 of barrier 110 that is at least three times as large as clearance distances 248A and 248B in the higher resistance flow areas 250A and 250B and by cap separation distances 255 which are also at least three times as large as clearance distances 248A and 248B. Accordingly, a much smaller proportion of the cross-module airflow 240 that flows through lower resistance flow channels 252 contacts a surface and therefore there is substantially less resistance to flow in lower resistance flow channels 252.

It is possible therefore to control the proportion of cross-module airflow 240 traveling through higher resistance flow areas 250A and 250B relative to the proportion of cross-module airflow 240 traveling through lower resistance flow channels 252 by controlling the resistance to cross-module airflow 240 in the higher resistance flow areas 250A and 250B relative to the resistance to cross-module airflow 240 in lower resistance flow channels 252.

In the embodiment of FIGS. 14-16 for example this is done by controlling the geometries of higher resistance flow areas 250A and 250B and lower resistance flow channels 252. For example, lower resistance flow channels 252 between caps 130A are defined by cap separation distance 255A and barrier distance 238. By adjusting either of cap separation distances 255A or barrier distance 238, the resistance to flow in the lower resistance flow channels 252 can be controlled. Similarly, the resistance to flow in higher resistance flow areas 250A and 250B can be controlled by adjusting clearance distance 248A and 248B.

In one embodiment, cap separation distances 255A between caps 130A and 130B are between 2 mm to 15 mm while cap extension distances 246A and 246B between second surface 122 and a portion of caps 130A and 130B in the higher resistance flow areas 252A and 252B are between about 2 mm to 6 mm and while clearance distances 248A and 248B are between about 0.5 to 2.0 mm. In other embodiments, a cap separation distance 255 between caps 130A and 130B can be at least about 0.1 to 0.2 times a width of nozzle arrays 104A and 104B respectively.

Only a portion of cross-module airflow 240 passes into higher resistance flow areas 250A and 250B and both the energy and volume of this portion of cross-module airflow 240 is reduced by the resistance to flow from the higher resistance to flow in higher resistance flow areas 250A and any portion of cross-module airflow 240 that enters higher resistance flow areas 250A and 250B is required to travel at least a threshold distance 297A and 297B along direction of receiver movement 42 within the higher resistance flow areas 250A before reaching first print line 123 or second print line 125 so that the resistance to flow causes such portions to lack the energy necessary to deflect ink droplets in a manner that can create image artifacts. While the threshold distances 297A and 297B that are useful in any printer design will be a function of various aspects of the printer, in certain embodiments, threshold distance 297 can be for example between about one to ten times a clearance distance 248. There is however sufficient flow through these higher resistance flow areas 250A and 250B to reduce a concentration of vaporized carrier fluid 116 in higher resistance flow areas 250A and 250B such that the risk of condensation buildup is reduced.

This arrangement protects against the possibility that any cross-module airflow 240 that does pass through higher resistance flow areas 250 will negatively influence placement of ink droplets 102A and 102B as they travel to receiver 24 and allows cross-module airflow generation system 220 to introduce a much greater volume of cross-module airflow 240 into entrance area 223 without creating unwanted variations in trajectories of ink droplets 102A and 102B than is possible without caps 130A and 130B.

Figure 17:
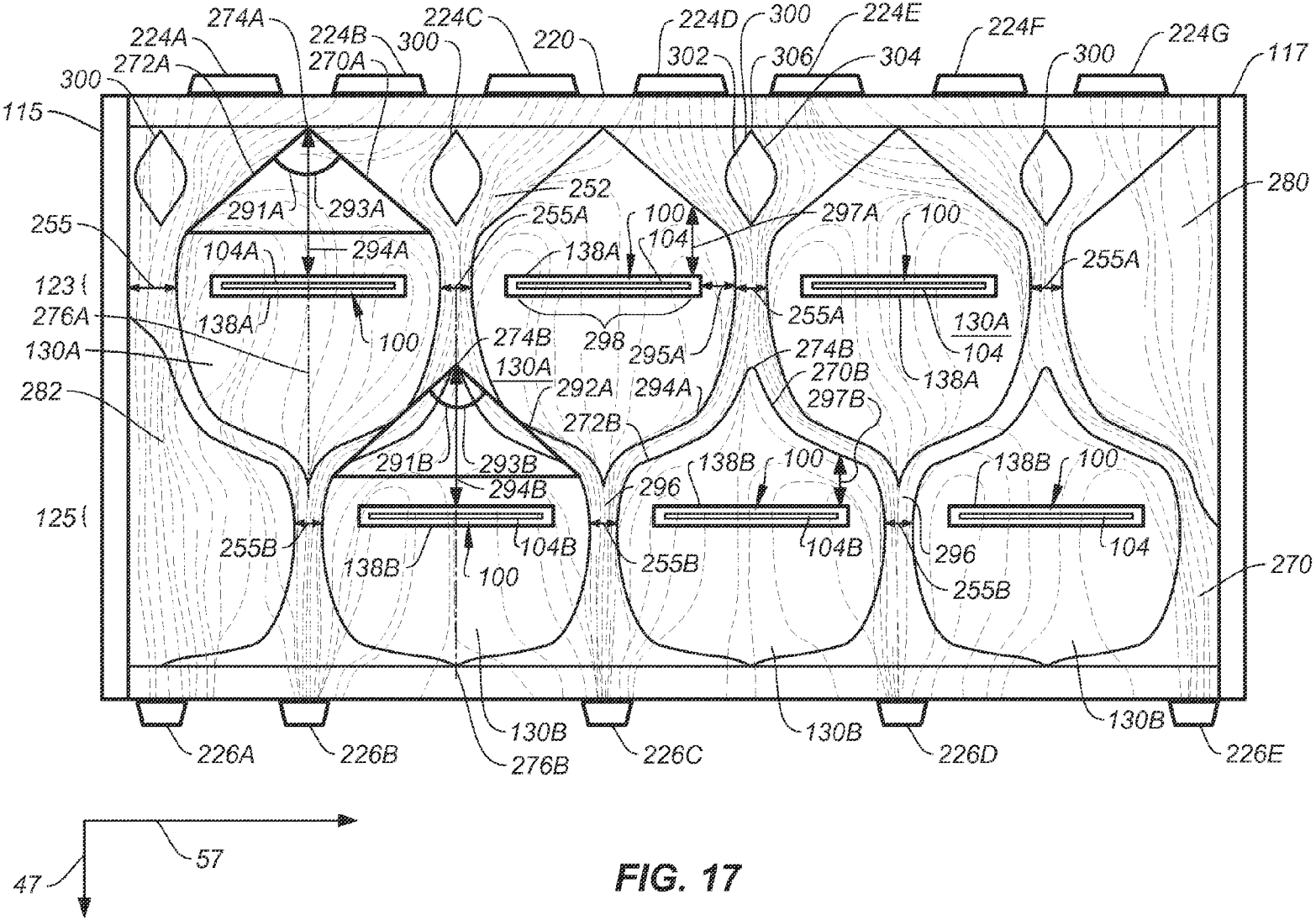

For example, FIG. 17 illustrates one example of an arrangement of printheads 100A and 100B having nozzle arrays 104A and 104B, second surface 122 and caps 130A and 130B as viewed from the perspective of receiver 24 that can be used, for example with the embodiment of condensation control system 118 of shown in FIGS. 14-16. In the example of FIG. 17, each array of nozzle arrays 104A and 104B has a common nozzle array width 298. The nozzle array width 298 has a significant influence on the size of caps 130A and 130B as caps 130A and 130B will be at least required to provide higher resistance flow areas 250A and 250B that extend across at least across nozzle array width 298 at each printhead 100.

Other characteristics of printing module 30-1 will also have an influence on the design and arrangement of caps 130A and 130B and these include but are not limited to characteristics such as a cross-sectional area of cross-module flow path 236, and any expected extent of variations in relative position of receiver 24 and nozzle arrays 104A and 104B. These factors can influence the extent to which caps 130A and 130B can extend from second surface 122 toward receiver 24 as it will be desirable to avoid contact between caps 130A and 130B and receiver 24.

There are a variety of factors that influence the design and arrangement of caps 130A and 130B of a condensation control system 118 and many of these factors are based on the characteristics of printing module 30-1. As an initial matter, it will be appreciated for any printing module, such as printing module 30-1 a primary design consideration will be the physical layout of printheads 100A and 100B, nozzle arrays 104A and 104B and faces 106A and 106B. Any arrangement of caps must capable of fitting within the physical layout of printheads 100A and 100B while still operating. Another factor is a printing distance or a range of printing distances over which inkjet nozzle arrays 104A and 104B are designed to eject ink droplets 102A and 102B during printing. Such factors can provide design constraints within which the characteristics of caps 130A and 130B can be determined.

Additional considerations can include but are not limited to rates of transport of receiver 24, the air flow characteristics of the materials used for caps 130A and 130B, evaporation rates of vaporized carrier fluid 116, expected printing rates, and the like. In certain embodiments, the placement arrangement of nozzle arrays 104A and 104B of printheads 100A and 100B will be determined first and the locations, shapes, sizes and other characteristics of condensation control system 218 can be determined based upon the design of the printheads 100A and 100B. In other circumstances the need for a condensation control system 118 that has controlled cross-flow and the requirement of providing caps 130A and 130B can be used as a design factor that influences the design, selection, arrangement or other characteristics of printheads 100A and 100B. These and other characteristics of printing module 30-1 can influence the design of caps 130A and 130B as well as the design of cross-module flow path 236.

It will be appreciated from the above that by providing controlled patterns of resistance to cross-module airflow 240, it becomes possible to provide a volume of cross-module airflow 240 pass through cross-module flow paths 236 that is sufficient to reduce the risk that vaporized carrier fluid 116 will condense into artifact creating droplets without such airflow creating errors in the placement of ink droplets 102A and 102B.

Management of Cross Module Airflow

Printing systems are expected to work without error when operated at any of a wide variety of different operating conditions. For example, printing speeds, printing densities, receiver types and environmental conditions can vary widely. Such conditions can influence the flow of cross-module airflow 240 through caps 130A and 130B and can interact with the structures of printing module 30-1, with receiver 24 and with condensation control system 118 in different ways under different conditions. Under many conditions, an arrangement of caps 130A and 130B will operate as described above.

However, in other conditions interactions between cross-module airflow 240, receiver 24, caps 130A and 130B and barrier 110 can create flow patterns that can cause at least a portion of cross-module airflow 240 to pass through higher resistance flow areas 250A or 250B to create drop placement errors and associated image artifacts. For example, under certain conditions, airflow related conditions such as back-pressure, recirculation, turbulence and other conditions can be created that give rise to unstable or higher pressure airflows in cross-module flow path 236 and that can, in turn, create image artifacts.

Accordingly, condensation control system 118 of FIGS. 14-17 has several cross-module airflow control features that reduce the risk that such flow conditions will arise or that reduce the intensity or severity of pressure increase created by such flow conditions. Several of these features will now be described with reference to FIGS. 16 and 17. For the purpose of simplifying the discussion of this embodiment, all caps 130A are identical and all caps 130B are identical, while different from caps 130A. Accordingly, to the extent that various features of caps 130A and 130B are illustrated with reference to different ones of caps 130A and 130B it should be assumed that such features are common to each of caps 130A and 130B respectively.

The cross-module airflow control features shown the embodiment of FIG. 17 include, for example, deflection surfaces 270A and 272B on first caps 130A. In this embodiment, deflection surfaces 270A and 270B are angled to cause cross-module airflow 240 to deflect from an initial direction parallel to direction of receiver movement 42 and to flow at least in part along width direction 57 into lower resistance flow channels 252 without requiring abrupt changes in direction of cross-module airflow 240 that can cause back pressure, recirculation, turbulence or other conditions that can build enough pressure against caps 130A of in first print line 123 to create non-uniform or unstable flows of cross-module airflow 240 that, in turn, deflect ink droplets (not shown) to create image artifacts.

Deflection surfaces 270A and 272A begin at vertices 274A and are sloped relative to direction of receiver movement 42 at generally equal deflection angles 291A and 293A to divide the cross-module airflow 240 and to guide different portions of cross-module airflow 240 into different ones of the lower resistance flow channels 252. In this embodiment, caps 130A have a mirror symmetry about a central axis 276A that extends along direction of receiver movement 42 through a center of caps 130A and through vertices 274A. Deflection surfaces 270A and 272A are illustrated as being generally flat and angles 291A and 293A can be for example between about 20 and 70 degrees. In other embodiments deflection surface 270A and 272A extend away from vertices 274A at a slope of between 0.25 and 1.0 relative to the direction of receiver movement 42. In still other embodiments, deflection surfaces 270A and 270B can have surfaces that are curved, bent or otherwise shaped to provide controlled deflection of cross-module airflow 240 without creating turbulence, recirculation, or backpressure as discussed above. In some embodiments, it can be effective to use deflection surfaces 270A and 272A that are curved in a convex manner.

In some embodiments of this type, caps 130A have vertices 274A that extend upstream from nozzle array 104A by a cap lead-in distance 294A that is greater than one fourth of a nozzle array width 298A of nozzle array 104A. In other embodiments, it can be useful provide cap 130A having vertices 274A that extend upstream from a nozzle array 104A by a threshold distance 297A that is greater one third of the length of a nozzle array width 298A of nozzle array 104A. In still other embodiments, caps 130A can be shaped so that a vertex 274A extends upstream from nozzle arrays 104A by a threshold distance 297A of at least ten times more than a clearance distance 248A between a cap 130A and receiver 24.

In the embodiment illustrated in FIG. 17, a threshold distance 297A is provided between deflection surfaces 270A and 272A and openings 138A in caps 130A. This ensures that any cross-module airflow 240 that is deflected by any portion of either of deflection surfaces 272A and 272B will have at least a threshold travel distance through which cross-module airflow 240 must flow through higher resistance flow areas 250A in order to reach openings 138A. Threshold distance 297A provides threshold resistance to cross-module airflow 240 that any portion of cross-module airflow 240 will have to overcome before it can influence a path of travel of any ink droplets (not shown) emitted by nozzle arrays 104A. As noted above, such a threshold distance 297A a distance that cap 130A extends upstream from an opening 138A in cap 130A that is calculated to reduce the energy of a portion of cross-module airflow 240 entering a higher resistance flow area 250A created by a cap 130A to a level that is below a level that is necessary to deflect ink droplets 102A in a manner that can create image artifacts. In one embodiment, the threshold distance 297A can be greater than about a quarter of a width of a nozzle array 104A about which cap 130A is located. In other embodiments, a threshold distance 297A can be at a distance that is at least ten times more than a clearance distance 248A between cap 130A and receiver 24 in a higher resistance flow area 250A formed between cap 130A and receiver 24.

It will be appreciated that the above described embodiments of deflection surfaces 270A and 2708 are shaped to divide cross-module airflow 240 so that cross-module airflow 240 is divided generally evenly and flows about caps 130A of first print line 123 in a generally balanced fashion. However, this in turn assumes that cross-module airflow 240 is not significantly unbalanced when incident on deflection surfaces 270A and 270B. To help ensure such balance, the embodiment of FIG. 17 a plurality of individual supply ducts 224A, 224B, 224C, 224D 224E, 224F and 224G are arranged across width direction 57 to supply a balanced flow of cross-module airflow 240 from blower 222 (see FIG. 14) of around each caps 130A. In particular it will be noted that, in this embodiment, supply duct 224A is aligned with deflection surface 272A while supply duct 224B is aligned generally with deflection surface 270A. Similarly, supply ducts 224C, 224D, and supply ducts 224E and 224F are aligned with other ones of deflection surfaces 270A and 272A. By supplying a generally level amount of airflow from each of supply ducts 224A-224G a balanced flow around caps 130A is more easily achieved.

As is also illustrated in FIGS. 16 and 17, caps 130A and 130B are shaped and are separated to cause lower resistance flow channels 252 to pass nozzle arrays 104A that have cap separation distances 255A and 255B that are generally constant and paths of travel that directions that do not vary more than about 10 degrees so that divided portions of cross-module airflow 240 pass nozzle arrays 104A without being caused to change direction or to concentrate in ways that can create pressures that push through higher resistance flow areas 250A along width direction 57. In this way, it is possible to substantially reduce the possibility that the placement of ink droplets 102A will be negatively impacted by flows of air that push laterally into higher resistance flow area 250A under caps 130A and into the path of travel of ink droplets from nozzle arrays 104A with enough force to create variations in the path of travel of ink droplets that, in turn, create image artifacts while providing a width direction separation 295 that is less than half of cap lead-in distance 294A.

A further aspect of the embodiment of FIG. 17 that is useful for managing cross-module airflow 240 is the provision of surfaces that guide cross-module airflow 240 after cross-module airflow 240 passes nozzle arrays 104A of first print line 123 so that airflow in this region does not create back-pressure, recirculation, turbulence or other conditions that can disrupt printing in nozzle arrays 104B of second print line 125 or cause any condensation that might occur to accumulate along the trailing edge of the caps.

In the embodiment that is illustrated in FIG. 17 control over airflow in this region is provided by shaping and spacing trailing surfaces 292A and 295A of caps 130A that are downstream of nozzle arrays 104A and by shaping and spacing deflection surfaces 270B and 272B of caps 130B so that these features combine to cause portions of cross-module airflow 240 that have gone past caps 130A on different sides thereof to be deflected along graduated deflection paths leading these separated portions to converge into a common stream at one of confluences 296.

In the embodiment that is illustrated in FIG. 17, deflection surfaces 270B and 272B meet at vertices 274B and are sloped relative to direction of receiver movement 42 and have a mirror symmetry about a central axis 276B that extends along direction of receiver movement 42 through a center of caps 130B and are curved surfaces that are shaped to cooperate with trailing surfaces 288A and 286A of caps 130A respectively to provide controlled deflection of cross-module airflow 240 without creating turbulence, recirculation, or back-pressure as discussed above.

In this embodiment, deflection surfaces 270B and 272B are shown shaped in a concave fashion corresponding to a convex shape of trailing surfaces 286A and 288A. In the embodiment illustrated this is done to create approximately constant width lower resistance flow channels 252 between caps 130A of first print line 123 and caps 130B of second print line 125. This establishes a uniform flow through the channel and inhibits the formation of recirculation zones, which can track condensation, along the trailing edges of the caps 130A. In certain embodiments deflection surfaces 270B and 272B extend away from vertices 274B at a slope of between 0.1 and 1.0 relative to the direction of receiver movement 42.

Also in this embodiment, at least one of caps 130B has a vertex 274B that extends upstream from nozzle array 104B by a threshold distance 297B that is greater one fourth of a nozzle array width 298B of nozzle array 104B. In other embodiments, it can be useful to define such shapes to provide a pattern of caps 130B that extend upstream from a nozzle array 104B by a threshold distance 297B so that resistance to flow in higher resistance flow areas 250B reduces the energy of any portion of the cross-module airflow 240 entering the higher resistance flow area 250B to a level that is below a level that is necessary to deflect ink droplets 102B in a manner that can create image artifacts. In one embodiment, the threshold distance 297B can be greater than about a quarter of a width of a nozzle array 104B about which cap 130B is located. In other embodiments, a threshold distance 297B can be at a distance that is at least ten times more than a clearance distance 248B between cap 130B and receiver 24 in a higher resistance flow area 250B formed between cap 130B and receiver 24.

It will be appreciated that the terms vertex and vertices have been used generically as a reference to a point of caps 130A and caps 130B where deflection surfaces 270A and 272A meet and where deflection surfaces 270B and 272B meet such that portions of cross-module airflow 240 on one side of such a vertex or vertices are deflected by deflection surfaces 270A and 270B respectively and such that portions of cross-module airflow 240 on another side of such a vertex or such vertices are deflected by deflection surfaces 272A and 272B respectively. In some cases these points may comprise a proper vertex of a triangle; however in other cases these points may take other forms such as tangent points on a curved surface. The terms vertices and vertexes are used herein to encompass any point of any geometry that meets the above described conditions.

As is noted above, cross-module airflow 240 will seek paths of least resistance to flow, according to the extent to which cross-module airflow 240 is deflected along a width direction 57 as cross-module airflow 240 passes through a cross-module flow path 236, there is a risk that enough of cross-module airflow 240 will escape from cross-module flow path 236 to limit the efficacy of condensation control system 118, particularly with respect to second print line 125.

Accordingly, in the embodiment of FIGS. 14-17 the flow of any cross-module airflow 240 along width direction 57 is contained by sidewalls 115 and 117; however sidewalls 115 and 117 provide ultimate limits on the extent to which cross-module airflow 240 can be deflected along width direction 57. In this regard, sidewalls 115 and 117 can comprise air impermeable barriers to cross-module airflow 240 or can comprise semi-permeable barriers that allow less than 50% of cross-module airflow 240 to pass through. Sidewalls 115 and 117 can also comprise impermeable or semi-permeable barriers to vaporized carrier fluid 116 or condensates thereof.

While the airflow containment provided by sidewalls 115 and 117 helps to ensure the efficacy of cross-module airflow 240 there is a potential that interactions between sidewalls 115 and 117 and cross-module airflow 240 can create recirculation zones, backpressure, turbulence or other conditions that can create airflows that disrupt printing either at first print line 123 or at second print line 125. To reduce the possibility that this will occur, a side flow control structure 280A is provided at an end of first print line 123 and side flow control structure 280B is positioned at an opposite end of second print line 125. Side flow control structure 280A is generally shaped and sized to correspond to the shapes and size of an adjacent cap 130A and is positioned between sidewall 117 and the adjacent cap 130A so as to create a higher resistance flow area 250C and a lower resistance flow channel 252 that has flow characteristics that are similar to the flow characteristics of lower resistance flow channels 252 between caps 130A. Similarly, side flow control structure 280B is generally shaped and sized to correspond to the shapes and size of an adjacent cap 130B and is positioned between sidewall 115 and an adjacent cap 130B so as to create a higher resistance flow area 250C and a lower resistance flow channel 252 that has flow characteristics that are similar to the flow characteristics of lower resistance flow channels 252 between caps 130A.

Side flow control structures 280A and 280B can be integral to sidewalls 115 and 117 or can be separate therefrom. Where caps 130A and 130B are heated as discussed in various embodiments above, side flow control structures 280A and 280B can be heated in a similar manner. Additionally, where useful side flow control structures 280A and 280B can have openings (not shown) similar to the openings 138 of caps 130A and 130B if required or useful to better control cross-module airflow 240. Additionally, where useful an air flow can be directed out of such openings in the side flow control structures 280A and 280B that is similar to the co-linear air flow provided through the openings 138 of the caps 130A and 130B.

Also shown in FIG. 17 are optional flow guides 300 that are positioned between caps 130A and supply ducts 224A-224F, and that each provide deflection surfaces 302 and 304 that are sloped from a vertex 306 to create a channeled flow of cross-module airfow 240 into engagement with caps 130A. This reduces the opportunity for turbulent or other non-channeled flow to arise as cross-module airflow 240 travels from supply ducts 224A-224F to caps 130A and can optionally be used to further help to balance cross-module airflow 240.

An additional cross-module airflow control feature illustrated in the embodiment of FIG. 17 is the use of vacuum ports 226A, 226B, 226D and 226E to draw cross-module airflow 240 from cross-module flow path 236. The vacuum suction provided by vacuum ports 226A, 226B, 226C, 226D and 226E helps to reduce back pressure in cross-module flow path 236, to remove any entrained air 242 traveling along with receiver 24 along with any vaporized carrier fluid 116 therein, and helps to remove cross-module airflow 240 and any vaporized carrier fluid 116 therein from cross-module flow path 236.

In this embodiment the use of vacuum ports 226A, 226B, 226C, 226D and 226E to provide vacuum suction makes it is possible to provide vacuum suction within limited ranges of positions along width direction 57 that are aligned with lower resistance flow channels 252. For example, as is shown here, in this embodiment vacuum ports 226B, 226C, and 226D are aligned with confluences 296 and therefore help to ensure that pressure buildups do not occur at such confluences 296 and in regions that flow into confluences 296. By providing vacuum suction in limited areas that align with lower resistance flow channels 252 the effect of the vacuum suction in higher resistance flow areas 250B is spatially limited. This lowers the risk that such vacuum suction will, itself, induce flows of in higher resistance flow areas 250B that have a potential for causing print artifacts. The extra vacuum flow removes moist air from the local vicinity of the printhead exit in addition to the air passing underneath the printhead. In some cases, this can allow greater vacuum suction to be used than would be possible in alternative embodiments where vacuum suction is provided generally across an exit area 225 of cross-module flow path 236.

In this embodiment, additional vacuum ports 226A and 226E are shown that optionally provide vacuum suction along sidewalls 115 and 117 respectively to reduce the possibility that pressures can build up proximate thereto. The vacuum suction applied by vacuum ports 226A-226E can be, in one embodiment, about 60 to 65 cubic feet per minute. While in other embodiments, the vacuum suction applied by vacuum ports 226A-226E can be in a range of between about 30 to 100 cubic feet of air per minute.

It will be appreciated that the symmetrical shapes and arrangements illustrated in FIG. 17 are optional and that in other embodiments caps 130A and 130B, side flow control structures 280A and 280B or optional flow guides 300 such that cross-module airflow 240 can be asymmetrical so as to create stable pressures or flow volumes of cross-module airflow 240 in different ones of lower resistance flow channels 252. In one embodiment, this is done where it is presumed that substantially greater volume of printing will be done using nozzles on a side of printing module 30-1 that is closer a sidewall such as sidewall 115 than will be done closer to an opposing sidewall such as sidewall 117 or where printhead arrangements, geometries and airflow characteristics of cross-module flow path 236 dictate such a strategy. Optionally, individual supply ducts 224A, 224B, 224C, 224D, 224E, 224F and 224G and vacuum ports 226A, 226B, 226C, 226D, and 226E can be asymmetrically arranged.

Figure 18:
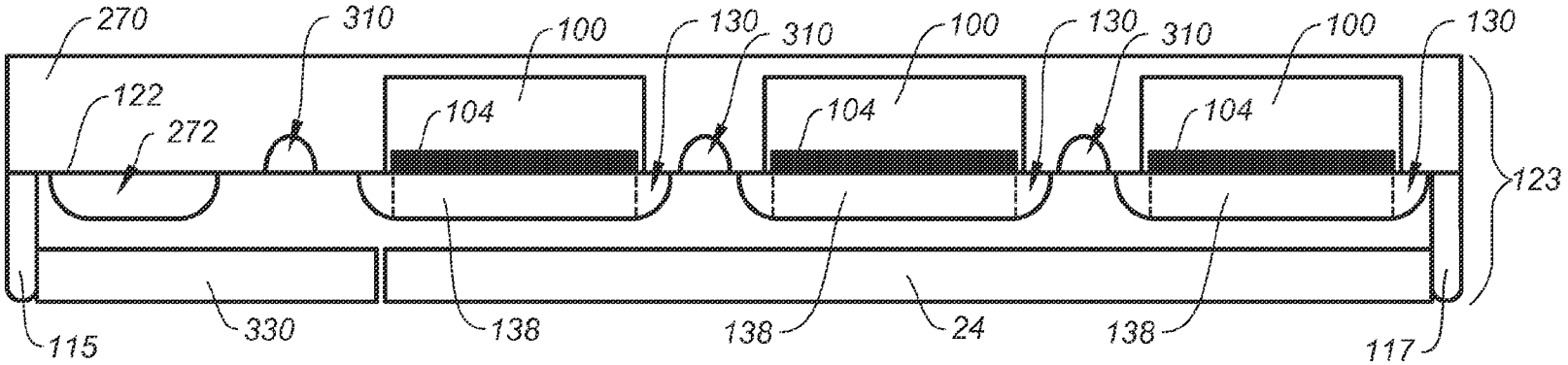
FIG. 18 illustrates another embodiment of a condensation control system with an optional plate.

FIG. 18 illustrates another embodiment of condensation control system 118. In this embodiment, barrier 110 has channels 310 positioned between caps 130A and 130B and correspond to areas into which caps 130 direct portions of cross-module airflow 240. Channels 310 provide additional clearance between second surface 122 of barrier 110 and a receiver 24. The increased clearance further reduces the resistance to cross-module airflow 240 in lower resistance flow channels 252.

In this regard, it will be appreciated that, to maintain optimal print quality, the spacing between for example an ink droplet catcher or a nozzle of the printhead 100 and receiver 24 should be kept to a minimum. However, to maintain large volumes of cross-module airflow 240 additional space is required. This embodiment enables the spacing between barrier 110 and receiver 24 to be large while still allowing a nozzle to receiver spacing to be maintained at a preferred smaller distance. By providing additional clearance between first surface 120 of barrier 110 and receiver 24, the risk of print defects caused by the receiver 24 contacting barrier 110 or moisture on barrier 110 is therefore reduced.

The embodiment that is illustrated in FIG. 18 is also shown having an optional receiver matching plate 330 aligned with receiver 24 such as by generally being positioned at barrier distance 238 (as shown in FIG. 15) from barrier 110. Receiver matching plate 330 occupies a portion of sidewall distance 239 along a width direction 57 between one of sidewall 115 and receiver 24 or between sidewall 117 and receiver 24 that is unoccupied by receiver 24.

Receiver matching plate 330 reduces air leakage under receiver 24 so that to provide more uniform airflow conditions across width direction 57 of printing module 30 so as to prevent creation of airflow between receiver 24 and barrier 110 that can create ink droplet placement errors either through deflection of receiver 24 or through deflection of ink droplets.

Co-Linear Flow Management

As is discussed above, and as is shown in FIG. 19, in some printers, ink droplets 102A emerge from openings 138A in caps 130A and 130B accompanied by a co-linear airflows 214A and 214B. Co-linear airflows 214A and 214B can have either individually or collectively have a higher pressures or volumes per unit time than portions 240A and 240B of cross-module airflow 240 that pass into a higher resistance flow areas 250A and 250B and that can deflect portions of cross-module airflows 240A and 240B that approach target areas 108A and 108B to further protect ink droplets 102A and 102B from being influenced by portions of cross-module airflow 240A and 240B to an extent that is necessary to cause an artifact to arise in a print.

Figure 19:
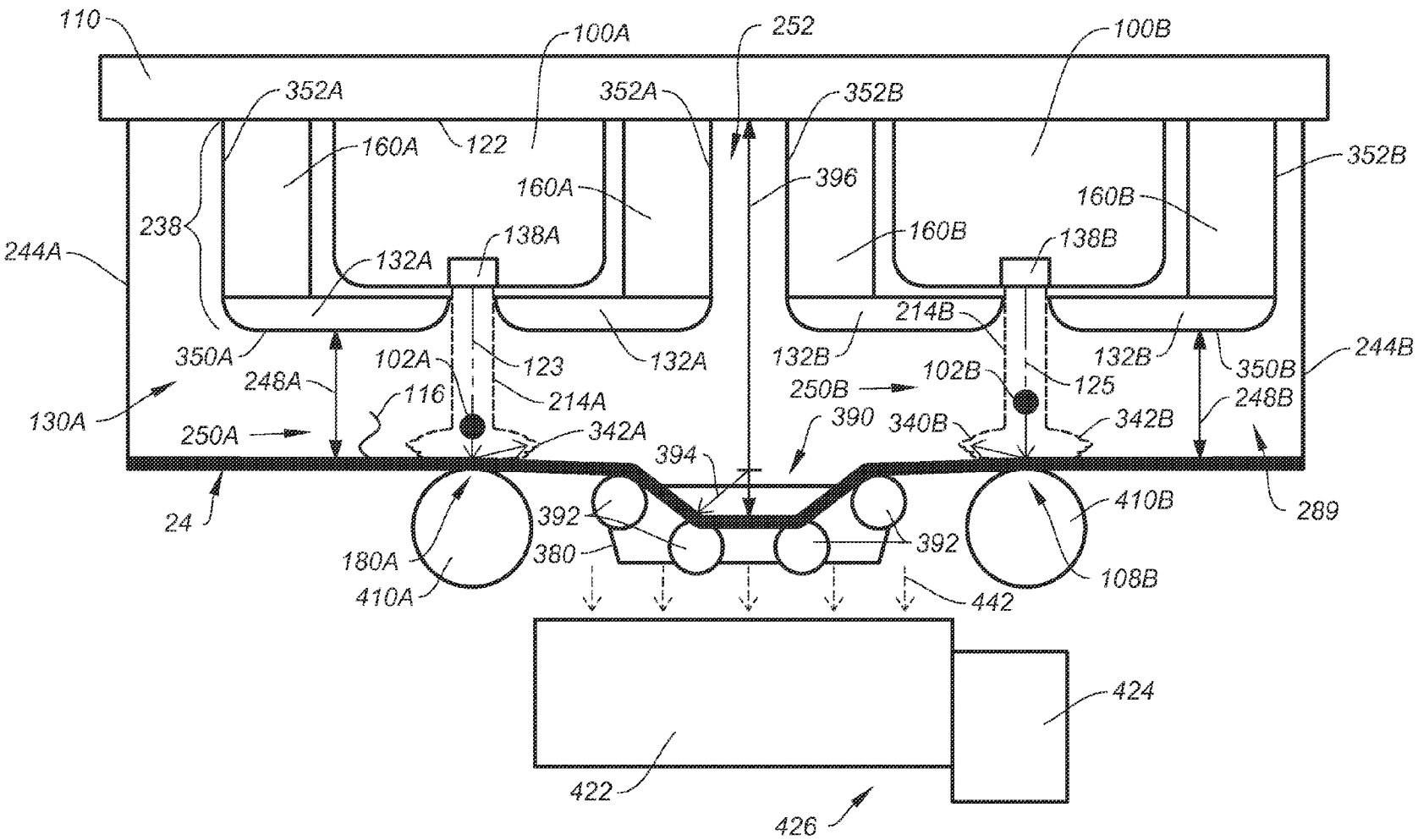
FIGS. 19 and 20 illustrate an additional embodiment of a condensation control system.

This effect is conceptually illustrated in FIG. 19 which shows portions 241A and 241B of cross-module airflow 240 that have passed through higher resistance flow areas 250A and 250B approaching openings 138A and 138B through which co-linear airflow 214A flows. As is shown in FIG. 19, portions 240A are redirected generally toward receiver 24 by co-linear airflow 214A. Portions 240A and co-linear airflow 214A strike receiver 24 and as is shown in FIG. 19 this impact creates upstream high pressure air 340A and 34013 on an upstream side of co-linear airflows 214A and 214B and also creates downstream high pressure air 342A and 342B on downstream side of co-linear airflows 214A and 214B, respectively. In some circumstances, the impact of co-linear airflow 214A against receiver 24 can help the drying process by breaking up any envelope of air that is traveling along with receiver 24. In doing so any vaporized carrier fluid 116 that has been carried in this envelope will be released proximate to caps 130A and 130B. This release can have the effect of raising the concentration of vaporized carrier fluid 116 that must be managed by condensation control system 118.

In this embodiment, the downstream high pressure air 342A and 342B flow through higher resistance flow areas 250A and 250B and into lower resistance flow channels 252 to flow with cross-module airflow 240 through lower resistance flow channels 252.

Returning to FIG. 19 it will be observed that downstream high pressure air 342A is also formed by co-linear airflow 214A from caps 130A of first print line 123 and can, in some instances, travel between caps 130A at first print line 123 and caps 130B in second print line 125 to combine with upstream high pressure air 340B created by co-linear airflow 214B at caps 130B of second print line 125.

The volume of co-linear airflow 214A and 214B and the downstream high pressure air 342A and upstream high pressure air 340B created thereby can benefit in certain circumstances from the use of a condensation control system 118 that provides additional features in order to allow the use of both cross-module airflow 240 and co-linear airflows 214A and 214B in order to reduce the risks that condensation will form in the cross-module flow path 236 while not creating airflows that cause errors in the placement of ink droplets 102A and 102B.

Figure 20:
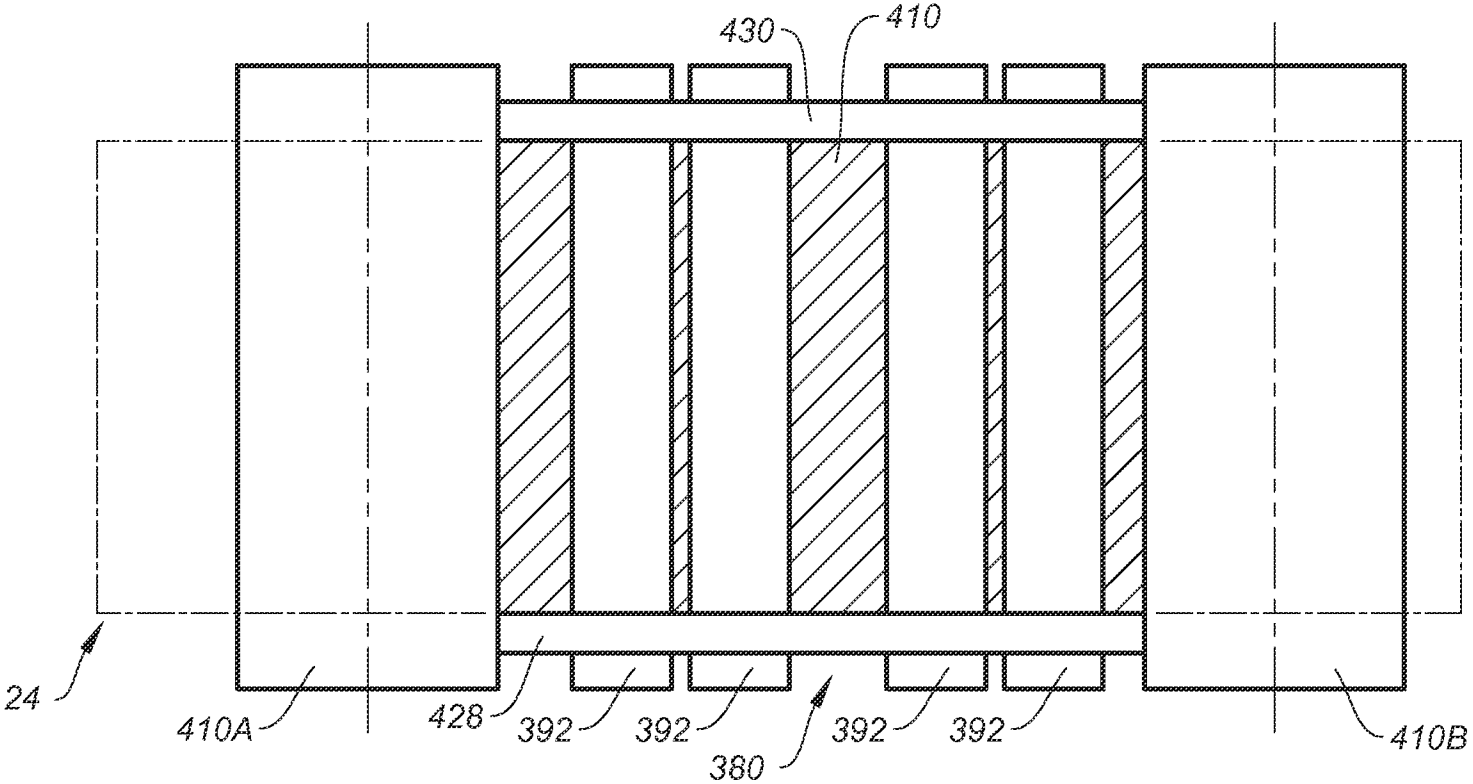

FIG. 20 illustrates one embodiment of a condensation control system 118 having caps 130A and 130B as generally described above with the additional feature of an integration assembly 380 that provides an arrangement of interline positioning surfaces 392 shown here as rollers along which receiver 24 can be moved to create additional distance between barrier 110 and receiver 24 between first print line 123 and second print line 125 to provide an integration volume 390 between first print line 123 and second print line 125. Here integration assembly 384 includes a frame 382 and appropriate bearings, mountings, joints or other known structures (not shown) that can be used to link frame 382 to interline positioning surfaces 392 at least in part determine a path of travel of receiver 24 between first print line 123 and second print line 125.

As is shown in FIG. 20, printing support surfaces 410A and 410B take the form of rollers that are disposed under receiver 24 to provide fixed support of receiver 24 at target areas 108A and 108B of first print line 123 and second print line 125. Receiver 24 is positioned at a first print line distance 244A from cap 130A by first printing support surface 410A shown here as a roller and is positioned at a second print line distance 244B from barrier 110 at second print line 125 by a second printing support surface 410B.

A plurality of interline positioning surfaces 392 are provided between first print line 123 and second print line 125. Receiver 24 is positioned by interline positioning surfaces 392 as receiver 24 passes from first print line 123 to second print line 125 such that while receiver 24 is between first print line 123 and second print line 125, receiver 24 is positioned at a far distance 396 that is greater than first print line distance 244A and second print line distance 244B. This provides an integration volume 390 between caps 130A, 130B, barrier 110 and receiver 24 where co-linear air flows 214A and 214B and cross-module airflow 240 can merge without creating flows that can enter the higher resistance flow areas 250A and 250B to create print artifacts on receiver 24.

In the embodiment that is illustrated here, far distance 396 is at least 30% greater than a first print line distance 244A and a second print line distance 244B between receiver 24 and barrier 110 at second print line 125 to create integration volume 390. In other embodiments, far distance 396 can be between about 25 to 100 percent greater than first print line distance 244A and second print line distance 244B. While in still other embodiments far distance 396 can be between about 35 to 40 percent greater than the first print line distance 244A and the second print line distance 244B. In one example embodiment, far distance 396 is 6 mm while first print line distance 244A is about 4 mm, second print line distance 244B is about 4 mm and clearance distances 248A and 248B are about 1 mm.

In some situations the aggregate flow of co-linear airflow 214 into integration area 390 by printheads 100A at a first print line 123 and a printheads 100B at second print line 125 in a printing module can create, generally, a positive pressure within integration volume 390 that helps to drive co-linear airflows 214A and 214B that flows into integration volume 390 into the lower resistance flow channels 252. For example, in some circumstances such aggregate co-linear airflow 214A and 214B can provide for example and without limitation 200 percent of the volume of air per unit time that is supplied by cross-module airflow 240. However, it will be appreciated the positive pressure should be lower than a pressure of the portion 241 of cross-module airflow 240 that flows through lower resistance flow channels 252 to avoid creating back pressure, turbulence or other problems in lower resistance flow channels 252 that can cause artifact inducing flows into higher resistance flow areas 250A and 250B.

In other situations, cross-module airflow 240 flowing through the lower resistance flow channels 252 draws co-linear airflow from integration area 390 into lower resistance flow channels 252 for flow therewith by creating a suction in lower resistance flow channels 252 proximate integration area 390. The suction in lower resistance flow channels 252 can be supplemented by vacuum applied proximate to lower resistance flow channels 252 by vacuum ports 226 as is illustrated for example with respect to FIG. 17.

There are a variety of different ways in which interline positioning surfaces 392 can be used to position receiver 24. In the embodiment that is illustrated in FIG. 20, receiver 24 is drawn against interline positioning surfaces 392 by use of a vacuum assembly 420. In one embodiment, such a vacuum assembly 420 is provided using a vacuum manifold 424 that is located between printing support surfaces 410A and 410B. Vacuum manifold 424 is positioned opposite a second side 426 of receiver 24 and is positioned between first print line 123 and second print line 125. For example, in the illustrated embodiment, vacuum manifold 424 is between target areas 108A and 108B of first print line 123 and 125. As is shown in FIG. 20, vacuum manifold 424 has seals 428 and 430 that are disposed about interline positioning surfaces 392 so that a generally sealed area is created between receiver 24, interline positioning surfaces 392, vacuum manifold 424 and seals 428 and 430. In the embodiment illustrated in FIG. 20, seals 428 and 430 are separated by a width of receiver 24 and extend from a vacuum source 440 that is fluidically coupled to vacuum manifold 424.

Optionally, in other embodiments of this type, printing support surfaces 410A and 410B can be incorporated, at least in part into the area to which vacuum is applied by vacuum manifold 424. In such embodiments, seals 428 and 430 and vacuum manifold 424 can be arranged accordingly.

In some embodiments, a single vacuum source 440 can be used to provide a vacuum force 442 to multiple vacuum manifolds 424 located at different positions along width direction 57 or to a single vacuum manifold 424 having multiple ports arranged along width direction 57. Additionally, in some embodiments, vacuum source 440 can be located remotely from condensation control system 118 such as an external vacuum system, which is connected to the one or more vacuum manifolds 424 of condensation control system 118 by means of vacuum ducts (not shown).

When a vacuum force 442 is output by vacuum manifold 424 during printing, the vacuum force 442 acts on receiver 24 between printing support surfaces 410A and 410B and pulls receiver 24 towards vacuum manifold 424 until further movement of receiver 24 toward vacuum manifold 424 is stopped by the presence of interline positioning surfaces 392. The intensity of the vacuum force 442 applied by vacuum source 440 need be no greater than that which is necessary to draw receiver 24 against interline positioning surfaces 392. This causes receiver 24 to flow along a non-linear path between first print line 123 and second print line 125 and to pull away from barrier 110 using a force that is evenly applied to receiver 24 lowering the risk receiver 24 will be damaged during such bending and allowing such bending to occur without requiring contact with side of receiver 24 a printed side of receiver 24. As is discussed in greater detail above, this has the effect of creating an advantageous but not always necessary integration volume 390 in which a co-linear airflow 214A and 214B, downstream high pressure air 342A and upstream high pressure air 340B can be integrated and ultimately incorporated into one of lower resistance flow channels 252 for transport along with cross-module airflow 240.

The intensity of the vacuum force 442 applied to receiver 24 can be based on particular print job characteristics. The print job characteristics include, but are not limited to, a weight of receiver 24 and a content density of the image to be printed on receiver 24.

In other embodiments, other methods for guiding receiver 24 along a path that generates an integration volume 390 can be used, including but not limited to creating an electrostatic attraction between receiver 24 and interline positioning surfaces 392 such as by inducing first electrostatic charge on receiver 24 and by inducing a second, opposite, electrostatic charge on the interline positioning surfaces 392.

In further embodiments, receiver 24 can be caused to move between first print line 123 and a second print line 125 along a non-linear path between first print line 123 and a second print line 125 by inducing a running buckle in receiver 24. Such a running buckle can be created by causing temporary reduction in a speed at which receiver 24 is moved at a position that is downstream of the position of the desired running buckle relative to a position that is upstream of the position of the desired running buckle. This can be done, for example, where printing support surface 410A comprises a roller that is rotated to advance receiver 24 toward second printing support surface 410B which also comprises in this embodiment a roller that is at least temporarily operated at a rate of rotation that advances receiver 24 at a slower rate. This difference in rate of causes a buckle to form and the buckle can be maintained as a running buckle so long as after a desired extent of buckle is formed to rates of movement of receiver 24 at printing support surface 410A and at printing support surface 410B are generally equalized.

In still other embodiments, interline positioning surfaces 392 can comprise structures such as rails, pinch rollers, turn bars or other forms of guides that are arranged relative to frame 382 and printing support surfaces 410A and 410B to cause receiver 24 to move away from barrier 110 in a manner that creates integration volume 390. In some cases, this will involve controlled contact with a printed surface of receiver 24; however, in certain embodiments such contact can be acceptable such as where such contact can be done in an unprinted edge area of receiver 24.

Condensation Control System Using Controlled Surface Energy.

In any of the above described embodiments of condensation control system 118 it may be necessary or useful under certain circumstances to use other characteristics of caps 130A and 130B to help define the differences in resistance to cross-module airflow 240 provided in higher resistance flow areas 250A and 250B and in lower resistance flow channels 252, to reduce the extent to which condensation can occur on caps 130A and 130B and to help manage the flow of any condensation that does form on caps 130A and 130B. One way to accomplish this is by providing lower surface energy surfaces 350A and 350B that are positioned to confront higher resistance flow areas 250A and 250B and by providing higher surface energy surfaces 352A and 352B to confront lower resistance flow channels 252. This can be done, generally, in any of the above described embodiments.

For example, FIG. 19 illustrates caps 130A and 130B having lower surface energy surfaces 350A and 350B that have surface energies of less than about 32 ergs/cm2 while surfaces such as surfaces 352A and 352B that confront lower resistance flow channels 252 between caps 130A, 130B and barrier 110 can have surface energies that are greater than about 40 ergs/cm2. In such a system, vaporized carrier fluid 116 will condense, if at all, on surfaces 352A and 352B confronting lower resistance flow channels 252 in order to lower the Gibbs free energy of this system. This also provides a further level of protection against the possibility that vaporized carrier fluid 116 will condense to form droplets on surfaces in higher resistance flow areas 250A and 250B.

Examples of materials that have a surface energy below 32 ergs/cm2 include but are not limited to Polyethylene, Polydimethylsiloxane, Polytetrafluoroethylene (PTFE), Polytrifluoroethylene (P3FEt/PTrFE), Polypropylene-isotactic (PP), Polyvinylidene fluoride (PVDF). Examples of materials that have a surface energy above about 40 ergs/cm2 include but are not limited to Polyethyleneoxide (PEO); Polyethyleneterephthalate (PET); Polyvinylidene chloride (PVDC) and Polyamide, Polyimide, metals such as stainless steel, silicon, ceramics such aluminum oxide. Accordingly, in an embodiment such as the embodiment illustrated in FIG. 19 where caps such as caps 130A and 130B are formed using separate thermally insulating separators 160A and 160B and separate shields 132A and 132B, thermally insulating separators 160A and 160B have lower surface energy surfaces 350A and 350B confronting lower resistance flow channels 252 that have surface energies below 32 ergs/cm2 while shields 132A and 132B can have higher surface energy surfaces 352A and 352B that are above about 40 ergs/cm2.

In some embodiments, the surface energies of caps 130A and 130B will be determined by material properties of the materials used to form caps 130A and 130B. For example, in the embodiment of FIG. 19, thermally insulating separators 160A and 160B can be formed from materials that have surface energies that are below about 32 ergs per square centimeter while shields 132A and 132B can be formed from materials that provide surface energies that are above about 40 ergs per square centimeter.

In other embodiments, caps 130A and 130B can be coated with materials that will provide lower surface energy surfaces 350A and 350B confronting higher resistance flow areas that have, for example, surface energies that are below about 32 ergs per square centimeter. Similarly caps 130A and 130B can be coated with materials that will provide higher surface energy surfaces 352A and 352B confronting lower resistance flow channels 252 that have, for example, surface energies that are above about 40 ergs per square centimeter.

In still other embodiments, caps 130A and 130B can be differently processed to increase the surface energies of surfaces that confront lower resistance flow channels 252 such that these surfaces have surface energies that are above about 40 ergs per square centimeter. In one embodiment this can be done by bombarding a polymeric surface of a cap 130A that is made using a material such as a polyolefin with ions. This can be done using a flame treatment, which delivers reactive ions via a burning gas jet, or by corona surface treatment which bombards the surface with ions from a corona wire or mesh. In still other embodiments, a plasma surface treatment can be used. Here an ionized gas is discharged against a surface that will confront a lower resistance flow channel 252 to increase the surface energy of the surface. In still another embodiment, electron-beam (e-beam) irradiation can be used to increase the surface energy of a material used to make a cap 130A or 130B.

Optionally, barrier 110 can also have a second surface 122 that also has surface energy that is above 40 ergs per square centimeter. This can be done by making barrier 110 using a material that has such a surface energy, by coating barrier 110 using a material having such surface energy or by processing barrier 110 using a material that has such a surface energy. The materials and processes described above for providing surfaces of portions of caps 130A and 130B that have surface energies above 40 ergs per centimeter squared can likewise be used here to provide such surface energies with respect to second surface 122 of barrier 110. Optionally barrier 110 can have a second surface 122 having a surface energy that is higher than the surface energy of surfaces 352A and 352B preferably by at least five ergs/cm. Thus if the surface energy of surfaces 352A and 352B are 40 ergs/cm2, the surface energy of second surface 122 should be about 40 ergs/cm2 in this embodiment.

As is shown in the embodiment of FIG. 19, lower surface energy surfaces 350A and 350B having below about 32 ergs per centimeter squared about higher surface energy surfaces 352A and 352B having surface energies that are above about 40 ergs per squared centimeter. This can be done, in some embodiments, using a transitional region of intermediate surface energies providing a gradient of intermediate surface energies beginning at the surface energies that are at or above about 40 ergs per squared centimeter and ending at the surface energies that are below about 32 ergs per centimeter squared. This encourages the flow of any condensation away from lower surface energy surfaces 350A and 350B onto surface 352A and 352B.

In other embodiments such abutment should provide a continuous transition higher surface energy surfaces 350A and 350B to lower surface energy surfaces 350A and 350B.

Figure 21A:
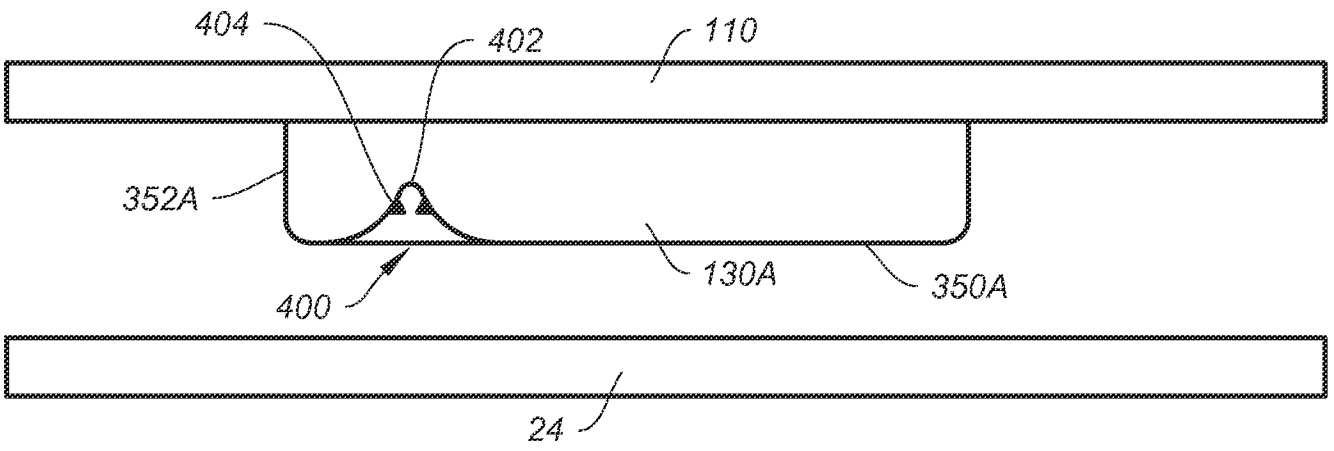
FIGS. 21A and 21B illustrate a further embodiment of a condensation control system.
Figure 21B:
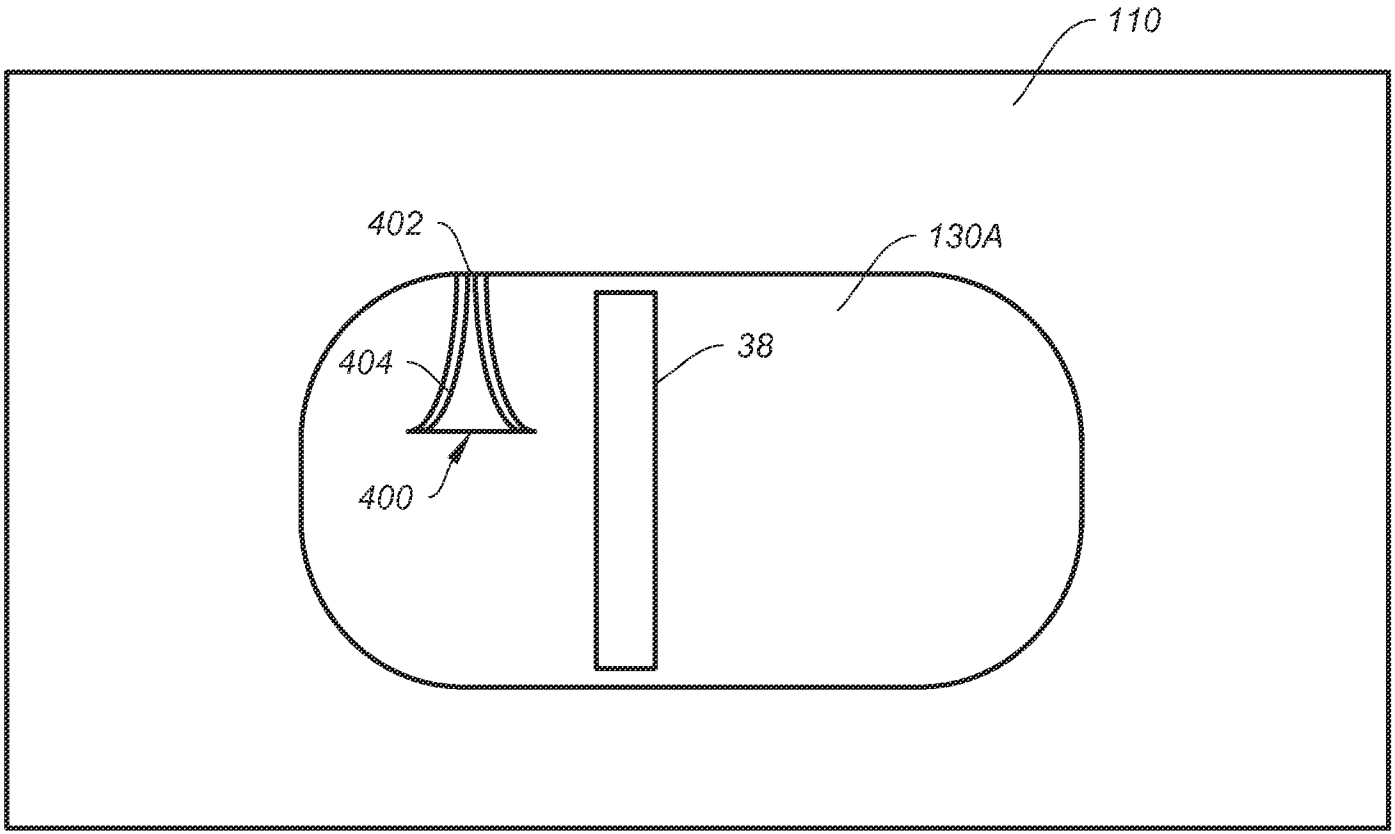

However, as is shown in FIGS. 21A and 21B in an alternative embodiment a smooth transition from higher surface energy surfaces 350A to lower surface energy surfaces 352A can incorporate a longitudinal trough 400 with a vertex 402 arranged to channel any condensate away from lower surface energy surface 350A and receiver 24, to higher surface energy surface 352A. This can be done by providing a longitudinal trough 400 in the form of capillary channels that are shaped with wider channel portions near a center of a caps such as a cap 130A and narrower portions toward the edges to draw any condensed carrier fluid from the center portions to edges thereof. This can also be done in other portions of barrier 110 where cross-module airflow is lower in order to draw a condensed carrier fluid from such areas into areas where there is a greater extent of cross-module airflow. In still other embodiments, grooves 404 can be supplied in troughs 400 to provide extra surface area. An additional advantage of this embodiment is that there is a low level of friction between lower surface energy surfaces 350A and 350B and any condensation that forms thereon. This low level of friction allows the cross-module airflow 240 to drive such condensation toward higher surface energy surfaces 352A and 352B.

Surface energy is measured by determining the contact angle between droplets of diiodo-methane and distilled water and the surface being measured. The polar and dispersive contributions to the surface energy are determined using these liquids and the interfacial energy calculated using the Good-Girifalco approximation.

Method for Operating a Printing System to Control Condensation

Figure 22:
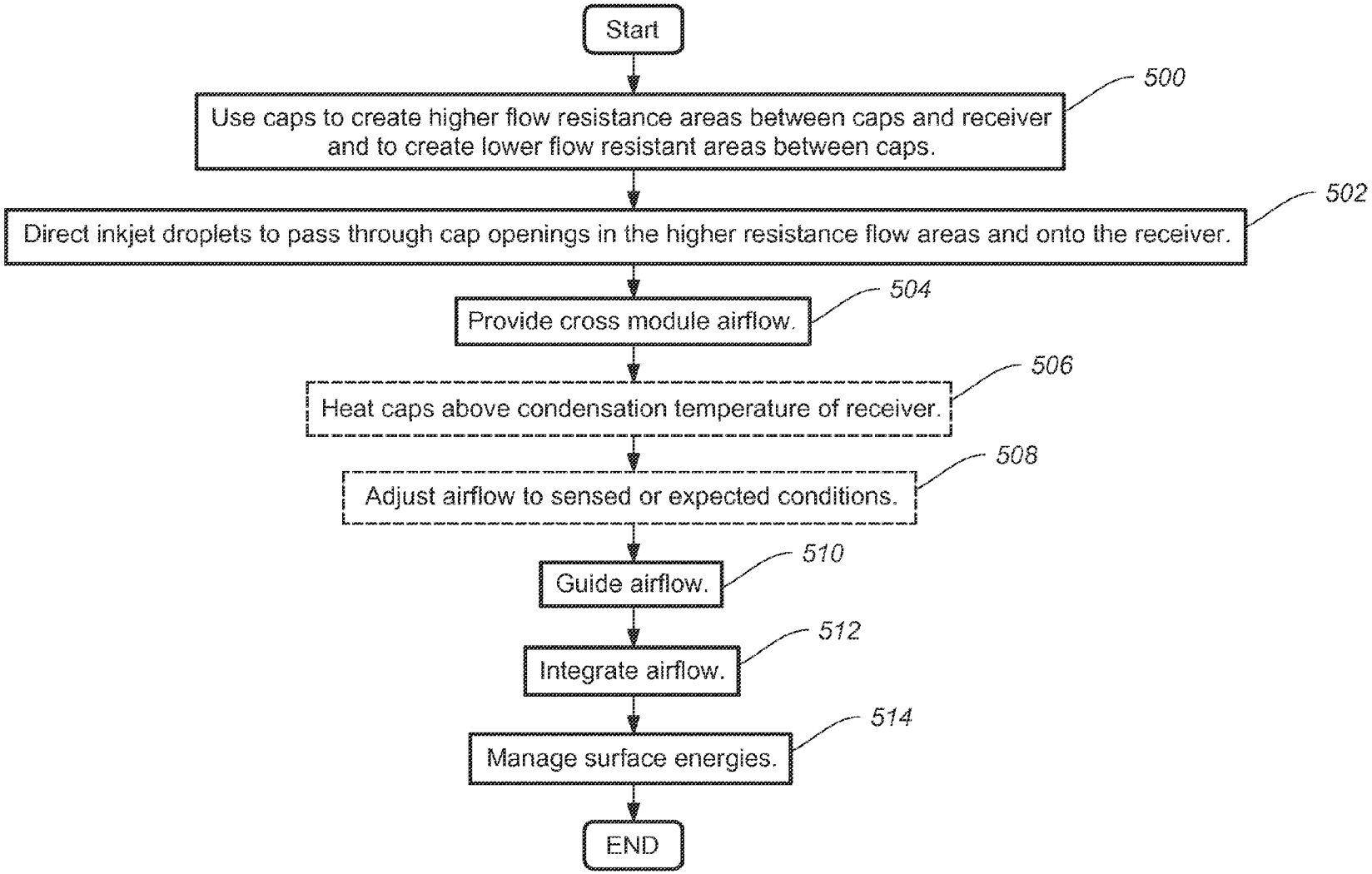
FIG. 22 is a flow chart of one embodiment of a condensation control method.

One embodiment of a method for operating a printing system is provided in FIG. 22 that can be executed using printing system controller 82 or control circuit 182 to control features as claimed.

In the embodiment of FIG. 22 one of a plurality of caps is used at each inkjet printhead to create a first region between each of the inkjet printheads and the shield and a second region between the shields and the target area, with the shield providing at least one opening between the first area and the second area through which the ink droplets can pass (step 500) and an air flow is created across the barrier with the caps being caps shaped to direct air flow moving proximate to the barrier into lower resistance flow channels apart from the openings (step 502). Optionally, an amount of energy is used to heat each shield that is controlled so that each shield can be heated to a different temperature that is at least equal to a condensation temperature of the vaporized carrier fluid in the printing region formed by that shield (step 504) and a pattern of channels in the barrier adjacent to the caps is optionally used to provide additional area within which a flow of air can move between the support surface and the receiver (step 506). It will be appreciated that these method steps can include steps that involve providing or assembling printers or condensation control systems that have any of the features described elsewhere herein.

Additionally, as is shown in FIG. 22, a further optional step (step 508) is provided in which data is determined including at least one of an expected or measured range of concentrations of a vaporized carrier fluid to be removed by the cross-module airflow, expected or measured temperatures of the air between the receiver and the barrier, expected or measured evaporation or condensation temperatures of any vaporized carrier fluid, the temperature of the air used in cross-module airflow, expected or measured resistance to airflow in the lower resistance flow channels and the higher resistance flow channels, the temperature of any vaporized carrier fluid 116 of any airflow moving with the receiver during printing, and a rate of cross-module airflow is established based upon the determined data from the sensors and known differences between the airflow resistance in the higher resistance flow areas and the lower resistance flow channels.

Printing system controller 82 and appropriate and known humidity, temperature, and flow sensors 86 can be used to measure such data and that memory 88 can contain data fields that can provide data from which printing system controller 82 can determine expected conditions based for example on heuristic data determined during previous printing operations with inkjet printing system 20 or based previous printing operations that have been performed by printers other than inkjet printing system 20 but having similar components. Optionally printing system controller 82 can consider the printing instructions and image data or any other information in a job order in order to determine the rate of cross module airflow to be used during a printing job.

It will also be appreciated that the drawings provided herein illustrate various arrangements components of various embodiments of condensation control system 118. Unless otherwise stated herein, these arrangements are not limiting. For example and without limitation, inkjet printing system 20 is illustrated with sensors 86, electrical heater 172 and energy source 180 being positioned on a face side 140 of shields 132 that confront printing region 136. However, in other embodiments, and unless stated otherwise these components can be located on sides 142 of shields 132 that confront shielded regions 134.

In various embodiments one or more of steps 510, 512 or 514 can be used, such as guiding airflow between caps 130A and 130B (step 510) and integrating airflow (step 512) which can be done for example, by urging the receiver away from the barrier along a path that leads the receiver to a far distance that is greater than the first barrier distance and the second barrier distance to create an integration volume between the first print line and the second print line where co-linear air flow and cross-module airflow integrate to allow the co-linear airflow and the cross-module airflow to flow in combination into lower resistance flow channels provided in separations between the first plurality of caps and the second plurality of caps without creating flows into the higher resistance flow areas that cause an observable artifact in a print made using printheads 100A and 100B, and providing controlled arrangements of surface energies step 514. Any of these steps can be performed as is described in greater detail above.

The invention has been described in detail with particular reference to certain preferred embodiments thereof, but it will be understood that variations and modifications can be effected within the spirit and scope of the invention.

What is claimed is:

1. A printing method comprising:

providing a cross-module air flow between a barrier and a receiver using a cross-module airflow generation system that includes at least one of a blower and a vacuum system;

creating higher resistance flow areas between the barrier and the receiver having a higher resistance to the cross-module airflow than is found in lower resistance airflow channels between the higher resistance flow areas, the barrier and the receiver;

directing droplets of an ink having a vaporizable carrier fluid to pass from the inkjet printheads to the receiver through the higher resistance flow areas; and wherein the cross module airflow removes at least some of any vaporized carrier fluid from between the barrier and the receiver and wherein the higher resistance to the cross-module airflow in the higher resistance flow areas causes the cross-module airflow to flow through the lower resistance airflow channels without creating airflows in the higher resistance flow areas that cause variations in the travel paths of the ink droplets that are sufficient to form an artifact in a print made on the receiver using the ink droplets.

2. The method of claim 1, wherein the higher resistance flow areas are formed by moving the receiver proximate to a portion of each of a plurality of caps that are each around a one of a plurality of printheads from which the ink droplets are directed with each cap having a portion that is proximate to a receiver to form one of the higher resistance flow areas, wherein the lower resistance flow channels are formed in separations between the caps and wherein the caps each have openings to allow the ink droplets to pass through one of a higher resistance flow area formed by the cap to the receiver.

3. The method of claim 2, further comprising heating at least a portion of each of the plurality of caps that form one of the higher resistance flow areas to a temperature that is at least equal to a condensation temperature of any vaporized carrier fluid in the higher resistance flow areas.

4. The method of claim 2, wherein the portions of the caps that form the higher resistance flow areas are positioned apart from the printheads to create a thermally insulating air gap, and wherein the portions that form the higher resistance flow areas are positioned further from the printheads when the portions that form the higher resistance flow areas are heated to higher temperatures than when the portions that form the higher resistance flow areas are heated to lower temperatures.

5. The method of claim 2, wherein a separation between at least two of the caps is between about 2 mm to 15 mm.

6. The method of claim 2, wherein a portion of a cap forming the higher resistance flow area is positioned at a cap distance from the barrier that is between about 2 mm to 6 mm.

7. The method of claim 2, wherein at least one of the higher resistance flow areas is created by positioning a receiver at clearance distance from the caps that is between about 2 mm to 6 mm in the higher resistance flow areas.

8. The method of claim 1, wherein at least one of the higher resistance flow areas is created by positioning a receiver at clearance distance from the caps that is at least about 0.1 to 0.2 times a width of inkjet nozzle arrays of the printheads.

9. The method of claim 1, wherein the cross-module airflow is between about 20 and 100 cubic feet per minute.

10. The method of claim 1, further comprising controlling a humidity of the cross-module airflow.

11. The method of claim 1, wherein the caps comprise shields that are positioned between the barrier and the target area by a plurality of thermally insulating supports made from at least one of Bakelite, tubular stainless steel and an aerogel.

12. The method of claim 1, wherein the shields comprise sheets that are less than about 1 mm in thickness.

13. The method of claim 2, wherein the openings are between about 2 mm and 6 mm wide in a smallest cross section.

14. The method of claim 1, wherein the volume of the cross-module airflow supplied between the printing module and the receiver is determined based upon the printing to be done.

15. The method of claim 1, further comprising requiring any portion of the cross module airflow that enters a higher resistance flow area to travel at least a threshold distance within the higher resistance flow areas before reaching an opening through which ink droplets are directed to the receiver so that resistance to flow causes reduces the energy in such cross-module flow to a level that is below a level that is necessary to deflect ink droplets in a manner that can create image artifacts.

16. The method of claim 1, further comprising determining data including at least two of an expected or measured range of concentrations of a vaporized carrier fluid to be removed by the cross-module airflow, expected or measured temperatures of the air between the receiver and the barrier, expected or measured resistance to airflow in the lower resistance flow channels and the higher resistance flow channels, expected or measured evaporation or condensation temperatures of any vaporized carrier fluid, the temperature of the air used in cross-module airflow, as well as the temperature or vaporized carrier fluid of any airflow moving with the receiver during printing, and supplying cross-module airflow based upon the determined data from the sensors and known differences between the airflow resistance in the higher resistance flow areas and the lower resistance flow channels.

17. The method of claim 1, further comprising determining the relative proportion of cross-module airflow traveling through higher resistance flow areas to the proportion of cross-module airflow traveling through lower resistance flow channels is determined based upon at least one of the resistance to cross-module airflow in the higher resistance flow areas and the clearance distances between the caps and the receiver, and at least one of the resistance to cross-module airflow in the lower resistance flow channels and a separation distance between the caps and the receiver and selecting a volume of cross-module airflow to be supplied between the barrier and the receiver per unit time based in order to achieve a threshold ratio that will prevent image artifacts from occurring.

18. The method of claim 1, wherein a volume of cross-module airflow supplied between the printing module and the receiver is determined based upon at least one of a type of ink to be used in printing, a speed of receiver movement and a range of a volume of ink droplets to be emitted per unit time during printing.

19. The method of claim 2, further comprising blocking the receiver from contacting the printheads or any inkjet nozzles in the printheads.

20. The method of claim 1, wherein at least one of the printheads has more than one inkjet nozzle array.

21. The method of claim 20, wherein at least one of the printheads has at least one separate opening for each of the inkjet nozzle arrays.

* * * * *